US007740062B2

(12) United States Patent
Lim et al.

(10) Patent No.: US 7,740,062 B2
(45) Date of Patent: Jun. 22, 2010

(54) SYSTEM AND METHOD FOR THE RECOVERY OF HYDROCARBONS BY IN-SITU COMBUSTION

(75) Inventors: Git Lim, Calgary (CA); John Ivory, Edmonton (CA); Roy Coates, Sherwood Park (CA)

(73) Assignee: Alberta Research Council Inc., Edmonton (CA)

( * ) Notice: Subject to any disclaimer, the term of this patent is extended or adjusted under 35 U.S.C. 154(b) by 221 days.

(21) Appl. No.: 12/022,310

(22) Filed: Jan. 30, 2008

(65) Prior Publication Data

US 2009/0188667 A1 Jul. 30, 2009

(51) Int. Cl.
*E21B 43/243* (2006.01)
*E21B 43/30* (2006.01)
*E21B 47/10* (2006.01)

(52) U.S. Cl. ..... 166/245; 166/50; 166/52; 166/57; 166/90.1; 166/251; 166/256; 166/261; 166/272.1; 166/272.7

(58) Field of Classification Search ..... None
See application file for complete search history.

(56) References Cited

U.S. PATENT DOCUMENTS

| | | | | |
|---|---|---|---|---|
| 2,365,591 A | | 12/1944 | Ranney | |
| 2,901,043 A | | 8/1959 | Campion et. al. | |
| 2,958,519 A | | 11/1960 | Hurley | |
| 2,969,226 A | * | 1/1961 | Huntington | 166/271 |
| 3,017,168 A | * | 1/1962 | Carr | 299/2 |
| 3,044,545 A | | 7/1962 | Tooke | |
| 3,132,692 A | * | 5/1964 | Marx et al. | 166/245 |

(Continued)

FOREIGN PATENT DOCUMENTS

CA 2088179 8/1993

(Continued)

OTHER PUBLICATIONS

Miller, K.A. et al., (2003) Air Injection Recovery of Cold-Produced Heavy Oil Reservoirs, (International Energy Agency's 24th Annual Workshop and Symposium on Enchanced Oil Recovery, Sep. 7-10, 2003, Regina, Saskatchewan, Canada).

(Continued)

*Primary Examiner*—George Suchfield
(74) *Attorney, Agent, or Firm*—Terrence N. Kuharchuk; Rodman & Rodman

(57) ABSTRACT

A system and a method for recovering hydrocarbons from a reservoir containing hydrocarbons, by in-situ combustion. The system includes a primary liquid production wellbore having a substantially horizontal primary production length extending through the reservoir, a vent well in fluid communication with the reservoir at a venting position which is relatively higher in the reservoir than the primary production length, an injector apparatus in fluid communication with the reservoir along an injection line in the reservoir which is relatively higher in the reservoir than the primary production length and relatively lower in the reservoir than the venting position, and an injection gas source connected with the injector apparatus. The method includes providing the system, injecting an injection gas containing oxygen into the reservoir to cause combustion of hydrocarbons contained in the reservoir, producing hydrocarbon liquid from the primary liquid production wellbore, and venting combustion gases from the vent well.

47 Claims, 13 Drawing Sheets

U.S. PATENT DOCUMENTS

| | | | | |
|---|---|---|---|---|
| 3,441,083 | A | 4/1969 | Fitzgerald | |
| 3,727,686 | A | 4/1973 | Prates et. al. | |
| 3,794,113 | A | 2/1974 | Strange | |
| 4,356,866 | A | 11/1982 | Savins | |
| 4,384,613 | A | 5/1983 | Owen et al. | |
| 4,390,067 | A | 6/1983 | Willman | |
| 4,397,356 | A | 8/1983 | Retallick | |
| 4,422,505 | A | 12/1983 | Collins | |
| 4,454,916 | A | 6/1984 | Shu | |
| 4,474,237 | A | 10/1984 | Shu | |
| 4,535,845 | A | 8/1985 | Brown et al. | |
| 4,545,430 | A | 10/1985 | Retallick | |
| 4,566,536 | A | 1/1986 | Holmes | |
| 4,566,537 | A | 1/1986 | Gussis | |
| 4,573,531 | A | 3/1986 | Garkusha et al. | |
| 4,574,884 | A * | 3/1986 | Schmidt | 166/263 |
| 4,625,800 | A | 12/1986 | Venkatesan | |
| 4,653,583 | A | 3/1987 | Huang et al. | |
| 4,662,441 | A | 5/1987 | Huang et al. | |
| 4,682,652 | A | 7/1987 | Huang et al. | |
| 4,696,345 | A | 9/1987 | Hsueh | |
| 4,700,779 | A | 10/1987 | Huang et al. | |
| 4,702,314 | A | 10/1987 | Huang et al. | |
| 4,718,485 | A | 1/1988 | Brown et al. | |
| 4,718,489 | A | 1/1988 | Hallam et al. | |
| 4,794,987 | A | 1/1989 | Kokolis et al. | |
| 4,834,179 | A | 5/1989 | Kokolis et al. | |
| 4,850,429 | A | 7/1989 | Mims et al. | |
| 5,016,709 | A * | 5/1991 | Combe et al. | 166/245 |
| 5,033,546 | A | 7/1991 | Combe | |
| 5,046,559 | A | 9/1991 | Glandt | |
| 5,211,230 | A | 5/1993 | Ostapovich et al. | |
| 5,217,076 | A * | 6/1993 | Masek | 166/303 |
| 5,273,111 | A | 12/1993 | Brannan et al. | |
| 5,339,897 | A | 8/1994 | Leaute | |
| 5,456,315 | A | 10/1995 | Kisman et al. | |
| 5,626,191 | A | 5/1997 | Greaves et al. | |
| 5,935,419 | A | 8/1999 | Khan et al. | |
| 6,016,867 | A | 1/2000 | Gregoli et al. | |
| 6,016,868 | A | 1/2000 | Gregoli et al. | |
| 6,167,966 | B1 | 1/2001 | Ayasse et al. | |
| 6,328,104 | B1 | 12/2001 | Graue | |
| 6,412,557 | B1 | 7/2002 | Ayasse et al. | |
| 6,530,965 | B2 | 3/2003 | Warchol | |
| 6,533,038 | B2 | 3/2003 | Venning et al. | |
| 7,516,789 | B2 * | 4/2009 | Chhina et al. | 166/260 |
| 2004/0050547 | A1 | 3/2004 | Limbach | |
| 2005/0082057 | A1 | 4/2005 | Newton et al. | |
| 2006/0162923 | A1 | 7/2006 | Ware | |
| 2006/0207762 | A1 | 9/2006 | Ayasse | |
| 2007/0068674 | A1 | 3/2007 | Turta et al. | |
| 2007/0284108 | A1 * | 12/2007 | Roes et al. | 166/302 |

FOREIGN PATENT DOCUMENTS

| | | |
|---|---|---|
| CA | 2046107 | 12/1994 |
| CA | 2096034 | 7/1996 |
| CA | 2176639 | 8/2000 |
| CA | 2246461 | 6/2002 |
| CA | 2255071 | 7/2003 |
| CA | 2569676 | 12/2005 |
| CA | 2579854 | 8/2007 |
| WO | 2005121504 | 12/2005 |
| WO | 2006074554 | 7/2006 |
| WO | 2007033462 | 3/2007 |
| WO | 2007095763 | 8/2007 |
| WO | 2007095764 | 8/2007 |

OTHER PUBLICATIONS

Al-Honi, M., Greaves, M. and Zekri, A.Y. (2002) Enhanced Recovery of Medium Crude Oil in Heterogeneous Reservoirs using Air Injection/In-Situ Combustion—Horizontal Well Technology, Petroleum Science and Air Technology, 20(5&6), 655-669.

Ayasse, C., Bloomer, C., Lynberg E., Boddy, W., Donnelly, J., Greaves, M. (2005) First Field Polot of the THAI process. CIPC, Calgary, AB., Jun. 7-9.

Belgrave, J.D.M., Nzekwu, B., and Chhina, H.S. (2007) SADG Optimization with Air Injection. SPE Latin America and Caribbean Petroleum Engineering Conference, Buenos Aires, Argentina, Apr. 15-18.

Coates, R. Lorimer, S. and Ivory, J. (1995) Experimental and Numerical Simulations of a Novel Top Down In-Situ Combustion Process. International Heavy Oil Symposium, Calgary, AB, Jun. 19-21.

Galas, C.M.F., Ejiogu, G.C. and Donnelly, J.K. (1991) Fluid and Heat Movements during In-Situ Combustion in a Channelled Reservoir. JCPT May/Jun. 30(3).

Greaves, M. and Al-Honi, M. (2000) Three-Dimensional Studies of In-Situ Combustion Horizontal Wells Process with Reservoir Heterogeneities. JCPT 39(10)25-32.

Greaves, M. and Al-Shamali, O. (1996) In Situ Combustion (ISC) Process Using Horizontal Wells, JCPT 35(4) 49-55.

Greaves, M. and Mahgoub, O. (1996) 3D Physical Model Studies of Air Injection in a Light Oil Reservoir Using Horizontal Wells, International Conference on Horizontal Well Technology, Calgary, AB Nov. 18-20.

Greaves, M., Tuwil, A.A., Bagci, A.S. (1993) Horizontal Producer Wells in Situ Combustion (ISC) Processes, JCPT, Apr. 32(4) 58-67.

Greaves, M. and Saghr, A.M. (1998) Sleeving-back of Horizontal Wells to Control Downstream Oil Saturations and Improved Oil Recovery, SPE International Conference on Horizontal Well Technology, Calgary, AB Nov. 1-4.

Greaves, M., Saghr, A.M., Xia, T.X., Turta, A.T. and Ayasse, C. (2001) THAI-New Air Injection Technology for Heavy Oil Recovery and In Situ Upgrading. JCPT 40(3) 38-47.

Greaves, M., Wilson, A., Al-Honi, M. and Lockett, A.D.(1996) Improved Recovery of Light/Medium Heavy Oils in Heterogenous Reservoirs Using Air Injection/Insitu Combustion (ISC). SPE 35693, Western Regional Meeting, Anchorage, Alaska May 22-24.

Greaves, M., and Xia, T.X. (2000) Simulation Studies of THAI Process, CIPC Jun. 4-8.

Greaves, M., and Xia, T.X (2004) Downhole Catalytic Process for Upgrading Heavy Oil: Produced Oil Properties and Composition. JCPT, 43(9)25-30.

Greaves, M., Xia, T.X. and Ayasse, C. (2005) Underground Upgrading of Heavy Oil Using THAI—"Toe-to-Heel Air Injection", SPE/PS-CIM/CHOA International Thermal Operations and Heavy Oil Symposium, Calgary, AB, Nov. 1-3.

Greaves, M., Xia, T.X., Imbus, S. and Nero, V. (2004) THAI-CAPRI Process: Tracing Downhole Upgrading of Heavy Oil. CIPC Jun. 8-10.

Hallam, R.J. and Donnelly, J.K. (1993) Pressure-Up Blowdown Combustion: A Channeled Reservoir Process. SPE Advanced Technology Series 1(1) 153-158.

Lau, E.C., Good, W.K., Kanakia, V. (1995) COSH Performance and Economical Predictions for Six Field Types in Western Canada. International Heavy Oil Symposium, Calgary, AB, Jun. 19-21.

Miller, K.A., Moore, R.G., Ursenbach, M.G., Laureshen, C.J. and Mehta, S.A. (2001) Air Injection Recovery of Cold-Produced Heavy Oil Reservoirs. CIPC, Calgary, Jun. 12-14.

Miller, K.A., Moore, R.G., Ursenbach, M.G., Laureshen, C.J. and Mehta, S.A., Proposed Air Injection Recovery of Cold-Produced Heavy Oil Reservoirs, JCPT, Mar. 2002, 41(3), 40-49.

Moore, R.G., Belgrave, J.D.M.,Ursenbach, M.G., Laureshen, C.J., Mehta, S.A., Gomez, P.A. and JHA, K.N. (1999) In Situ Combustion Performance in Steam Flooded Heavy Oil Cores. JCPT, 38(13).

Mostafavi, S.V., Kharrat, R. and Razzaghi, S. (2007) Feasibility Study of In-Situ Combustion in a Carbonate Reservoir. 15th SPE Middle East Oil and Gas Show and Conference, Kingdom of Bahrain, Mar. 11-14.

Nzekwu, B.I., Hallam, R.J., and Williams G.J.J. (1990) Interpretation of Temperature Observation From a Cyclic-Steam/In-Situ-Combustion Project. SPE Reservoir Engineering, May, 163-169.

Razzaghi, S., Kharrat, R., Price, D., Vossoughi and Rashttchian, D. (2005) Feasibility Study of Autoignition Process in Heavy-Oil Reservoirs. SPE International Thermal Operation and Heavy Oil Symposium, Calgary, AB Nov 1-3.

Stokka, S., Oesthus, A. and Fangeul, J. (2005) Evaluation of Air Injection as an IOR Method for the Giant Ekofisk Chalk Field. SPE International Improved Oil Recovery Conference in Asia Pacific, Kuala Lumpur, Malaysia, Dec. 5-6.

Tabasinejad, F., Karrat, R. and Vossoughi, S. (2006) Feasibility Study of In-Situ Combustion in Naturally Fractured Heavy Oil Reservoirs. First International Oil Conference and Exhibition in Mexico, Cancun, Aug. 31-Sep. 2.

Thorton, B., Hassan, D. and Eubank, J. (1996) Horizontal Well Cyclic Combustion, Wabasca Air Injection Pilot. JCPT, 35(9) 40-44.

Tsang, P.W. (1989) Rationale for Low Injection Rates and Pressure Cycles for Firefloods in Heavy Oil Reservoirs. JCPT, Jan-Feb 28(1), 33-39.

Turta, A.T., Ayasse, C. Najman, J., Fisher, D. and Singhal, A. (2002) Laboratory Investigation of Gravity-Stable Waterflooding Using Toe-to-Heal displacement: Part I: Hele Shaw Model Results. SPE 78988, International Thermal Operations and Heavy Oil Symposium and International Horizontal Well Technology Conference, Calgary, Nov. 4-7.

Turta, A.T., Chattopadhyay, S.K., Bhattacharya, R.N., Conrachi, A. and Hanson, W. (2005) Current Status of the Commercial In Situ Combustion (ISC) Projects and New Approaches to Apply ISC. CIPC, Jun. 7-9.

Turta, A.T. and Singhal, A.K. (1999) Feasibility of Air Injection Based Processes for Williston Basin Reservoirs. International Williston Basin Horizontal Well Workshop, Regina, SK, Apr. 25-27.

Xia, T.X. and Greaves, M. (2002) Injection Well-Producer Well Combinations in THAI "Toe-to-Heel Air Injection". SPE/DOE Improved Oil Recovery Symposium, Tulsa, OK, Apr. 13-17.

Xia, T.X., Greaves, M. and Turta, A.T. (2002) Upgrading Athabasca Tar Sand Using Toe-to-Heel Injection. JCPT 41(8) 51-57.

Xia, T.X., Greaves, M. and Turta, A. (2005) Main mechanism for Stability of THAI—Toe-to-Heel Air Injection. JCPT (44)1.

Xia, T.X., Greaves, M., Turta, A.T. and Ayasse, C. (2003) THAI—A 'Short Distance Displacement' In Situ Combustion Process for the Recovery and Upgrading of Heavy Oil., Trans IChemE, vol. 81 Part A March.

Belgrave, J.D.M., et al., "A Comprehensive Approach to In Situ Combustion Modeling", paper presented to the SPE/DOE Seventh Symposium on EOR held in Tulsa, OK on Apr. 22-25, 1990.

Coates, R., "Revisiting Top Down In-Situ Combustion—An Alternative Bitumen Recovery Process", presented at Canadian Heavy Oil Association Slugging It Out Conference, Calgary, Alberta, Apr. 10, 2006.

Herron, E., Hunter, "Commercial Application of In Situ Upgrading of Heavy Oil" Petroleum Equities Inc., Dec. 2003.

Ivory, J. et al. "Development of a Top-Down Combustion Process", AOSTRA Conference "Oil Sands—Our Petroleum Future" Edmonton, Alberta, Apr. 4-7, 1993.

* cited by examiner

SYSTEM AND METHOD FOR THE RECOVERY OF HYDROCARBONS BY IN-SITU COMBUSTION

TECHNICAL FIELD

A system and a method for recovering hydrocarbons from a reservoir containing hydrocarbons by in-situ combustion.

BACKGROUND OF THE INVENTION

In-situ combustion (ISC) has the potential to be an economical thermal oil recovery process for heavy oil and oil sand deposits. The in-place fuel burned to generate heat in ISC is the least valuable portion of the oil. Moreover, ISC is not compromised by wellbore or overburden and underburden heat losses, and can potentially compete favourably with steam processes such as steam assisted gravity drainage (SAGD) for application to thin reservoirs.

Examples of ISC processes include those disclosed in: "Experimental and Numerical Simulations of a Novel Top Down In-Situ Combustion Process", Coates, R., Lorimer, S., Ivory, J., Society of Petroleum Engineers, SPE 30295, 1995; U.S. Pat. No. 5,211,230 (Ostapovich et al); U.S. Pat. No. 5,456,315 (Kisman et al); U.S. Pat. No. 5,626,191 (Greaves et al); U.S. Pat. No. 6,167,966 (Ayasse et al); U.S. Pat. No. 6,412,557 (Ayasse et al); PCT International Publication No. WO 2005/121504 A1 (Ayasse); PCT International Publication No. WO 2006/074555 A1 (Chhina et al); PCT International Publication No. WO 2007/095763 A1 (Ayasse); and PCT International Publication No. WO 2007/095764 A1 (Ayasse).

SUMMARY OF THE INVENTION

The present invention is a system and a method for recovering hydrocarbons from a reservoir containing hydrocarbons. The invention utilizes in-situ combustion (ISC).

The system of the invention is comprised of a primary liquid production wellbore, at least one vent well and an injector apparatus, all of which are associated with a reservoir containing hydrocarbons.

The primary liquid production wellbore has a substantially horizontal primary production length which extends through the reservoir. The vent well is in fluid communication with the reservoir at a venting position in the reservoir. The injector apparatus is in fluid communication with the reservoir along an injection line in the reservoir.

The venting position is relatively higher in the reservoir than the primary production length. The injection line is relatively higher in the reservoir than the primary production length, and the injection line is relatively lower in the reservoir than the venting position.

In a non-limiting system aspect, the invention may be a system for recovering a hydrocarbon liquid from a subterranean reservoir containing hydrocarbons, the system comprising:

(a) a primary liquid production wellbore having a substantially horizontal primary production length which extends through the reservoir, wherein the primary production length is positioned substantially within a vertical primary production plane;

(b) at least one vent well in fluid communication with the reservoir at a venting position in the reservoir which is relatively higher in the reservoir than the primary production length;

(c) an injector apparatus in fluid communication with the reservoir along an injection line in the reservoir which is substantially parallel with the primary production plane, wherein the injection line extends along at least a portion of the primary production length, wherein the injection line is relatively higher in the reservoir than the primary production length, and wherein the injection line is relatively lower in the reservoir than the venting position; and (d) an injection gas source connected with the injector apparatus, for supplying an injection gas containing oxygen to the injector apparatus for injecting along the injection line in order to cause combustion of the hydrocarbons contained in the reservoir.

The injection line may be comprised of a continuous line of injection or may be comprised of a plurality of discrete points of injection which together provide the injection line. The injection line may be laterally offset from the primary production plane. Alternatively, the injection line may be positioned substantially within the primary production plane, such that the injection line is substantially above the primary production length.

The injector apparatus may be comprised of one or more injection wellbores, so that the one or more injection wellbores provide the injection line.

As one non-limiting example, the injector apparatus may be comprised of an injection wellbore having a substantially horizontal injection length, and the injection line may be comprised of the injection length of the injection wellbore. As a second non-limiting example, the injector apparatus may be comprised of a plurality of injection wellbores, and each of the injection wellbores may be in fluid communication with the reservoir along the injection line in order to provide the injection line. As a third non-limiting example, the injector apparatus may be comprised of a row of substantially vertical injection wellbores, wherein each of the injection wellbores is in fluid communication with the reservoir along the injection line in order to provide the injection line.

The at least one vent well facilitates venting from the reservoir of gases contained in the reservoir. As non-limiting examples, gases contained in the reservoir may be comprised of gases produced from the combustion of hydrocarbons in the reservoir, unreacted injection gas and natural gas.

The venting position may be positioned substantially within the primary production plane. Alternatively, the venting position may be laterally offset from the primary production plane.

The at least one vent well may be comprised of a single vent well or a plurality of vent wells. The venting position may be comprised of a plurality of venting positions which are provided by a plurality of vent wells. Where the venting position is comprised of a plurality of venting positions, one or more of the venting positions may be located at different positions relative to the primary production plane. The vent wells may be comprised of vertical wells, directional wells, and/or may include substantially horizontal lengths which extend through the reservoir.

As one non-limiting example, each of the venting positions may be laterally offset from the primary production plane. As a second non-limiting example, at least one of the venting positions may be laterally offset from the primary production plane on a first side of the primary production plane and at least one of the venting positions may be laterally offset from the primary production plane on a second side of the primary production plane. As a third non-limiting example, at least one of the venting positions may be laterally offset from the primary production plane by a first venting distance on a first side of the primary production plane and at least one of the venting positions may be laterally offset from the primary production plane by a second venting distance on the first side of the primary production plane, wherein the second venting distance is greater than the first venting distance. As a fourth non-limiting example, one or more venting positions may be laterally offset from the primary production plane on different sides of the primary production plane and/or by different distances from the primary production plane.

The system may be further comprised of one or more offset liquid production wellbores, each having a substantially horizontal offset production length which extends through the reservoir, wherein the offset production length is laterally offset from the primary production plane. The injection line is preferably relatively higher in the reservoir than the offset production lengths.

The offset production lengths may be oriented in any direction relative to the primary production plane. For example, an offset production length may be oriented perpendicular to the primary production plane, oblique to the primary production plane, or parallel to the primary production plane.

The offset production lengths may be laterally offset from the primary production plane on the same side of the primary production plane or on different sides of the primary production plane. The offset production lengths may be laterally offset from the primary production plane by the same distance or by different distances from the primary production plane.

As one non-limiting example, offset production lengths may be laterally offset from the primary production plane on different sides of the primary production plane. As a second non-limiting example, offset production lengths may be laterally offset from the primary production plane by different distances on the same side of the primary production plane. As a third non-limiting example, offset production lengths may be laterally offset from the primary production plane on different sides of the primary production plane and by different distances from the primary production plane.

In some embodiments, the system may be comprised of a first offset liquid production wellbore having a first offset production length which is laterally offset from the primary production plane by a first production distance on a first side of the primary production plane. In some embodiments, the system may be comprised of a second offset liquid production wellbore having a second offset production length which is laterally offset from the primary production plane by a second production distance on the first side of the primary production plane, wherein the second production distance is greater than the first production distance.

In some embodiments, the system may be comprised of a third offset liquid production wellbore having a third offset production length which is laterally offset from the primary production plane by a third production distance on a second side of the primary production plane. In some embodiments, the system may be comprised of a fourth offset liquid production wellbore having a fourth offset production length which is laterally offset from the primary production plane by a fourth production distance on the second side of the primary production plane, wherein the fourth production distance is greater than the third production distance.

The first offset liquid production wellbore and/or the third offset liquid production wellbore may comprise a first set of offset liquid production wellbores, and the third production distance may be substantially equal to the first production distance.

The second offset liquid production wellbore and/or the fourth offset liquid production wellbore may comprise a second set of offset liquid production wellbores, and the fourth production distance may be substantially equal to the second production distance.

The number and selection of the venting positions is dependent upon the overall configuration of the system and upon other factors, including the number and configuration of the offset liquid production wellbores.

The injection gas source may be comprised of any source of an injection gas containing oxygen which is suitable for injection into the reservoir in order to cause combustion of the hydrocarbons contained in the reservoir. For example, the injection gas source may be comprised of a source of air, oxygen enriched air or some other oxygen containing gas. The injection gas source may be further comprised of a compressor, pump or other apparatus for delivering the injection gas to the injection line and the reservoir.

In a non-limiting method aspect, the invention may be a method for recovering a hydrocarbon liquid from a subterranean reservoir containing hydrocarbons, the method comprising:

(a) providing a primary liquid production wellbore having a substantially horizontal primary production length which extends through the reservoir, wherein the primary production length is positioned substantially within a vertical primary production plane;

(b) providing at least one vent well in fluid communication with the reservoir at a venting position in the reservoir which is relatively higher in the reservoir than the primary production length;

(c) providing an injector apparatus in fluid communication with the reservoir along an injection line in the reservoir which is substantially parallel with the primary production plane, wherein the injection line extends along at least a portion of the primary production length, wherein the injection line is relatively higher in the reservoir than the primary production length, and wherein the injection line is relatively lower in the reservoir than the venting position;

(d) injecting an injection gas containing oxygen into the reservoir along the injection line in order to cause combustion of the hydrocarbons contained in the reservoir, thereby heating the reservoir so that the hydrocarbon liquid drains toward the primary liquid production wellbore;

(e) producing the hydrocarbon liquid from the primary liquid production wellbore; and (f) venting, from the vent well, gases contained in the reservoir.

The method may be further comprised of pre-treating the reservoir before injecting the injection gas into the reservoir, in order to enhance the injectivity of the injection gas into the reservoir, in order to mobilize the hydrocarbons located adjacent to the injection line and the primary production length, in order to heat the hydrocarbons to facilitate combustion, or for some other purpose. Exemplary pre-treatments may be comprised of thermal pre-treatment by the introduction of heat into the reservoir, physical pre-treatment by diluting or dissolving the hydrocarbons contained in the reservoir, chemical pre-treatment by altering the chemical composition of the hydrocarbons contained in the reservoir.

In some embodiments, pre-treatment of the reservoir may be comprised of a thermal pre-treatment, a physical pre-treatment, or a combination of a thermal pre-treatment and a physical pre-treatment. In some embodiments, the method may be further comprised of injecting steam into the reservoir along the injection line for a steam injection period, before injecting the injection gas into the reservoir along the injection line. In some embodiments, the method may be further comprised of electrically heating the reservoir, injecting a solvent into the reservoir, or injecting a combination of steam and a solvent into the reservoir.

The method may be further comprised of providing one or more offset liquid production wellbores, each having a substantially horizontal offset production length which extends through the reservoir, wherein the offset production lengths are laterally offset from the primary production plane, and the method may be further comprised of producing the hydrocarbon liquid from the offset liquid production wellbores. The offset production lengths may be laterally offset from the primary production plane on the same side or on different sides of the primary production plane and/or may be laterally offset from the primary production plane by the same distance or by different distances from the primary production plane. Any number of offset liquid production wellbores may be provided in the invention.

The method may be further comprised of ceasing producing the hydrocarbon liquid from the primary liquid production wellbore upon detection of a threshold amount of a breakthrough gas at the primary liquid production wellbore. The threshold amount of the breakthrough gas may be any amount which is considered to be tolerable in the performance of the method, and may be represented by direct and/or indirect detection and/or measurement of the injection gas, its constituents or its products of combustion.

In some embodiments, the method may be further comprised of providing a first offset liquid production wellbore having a substantially horizontal first offset production length which extends through the reservoir, wherein the first offset production length is laterally offset from the primary production plane by a first production distance on a first side of the primary production plane, and the method may be further comprised of producing the hydrocarbon liquid from the first offset liquid production wellbore.

In some embodiments, the method may be further comprised of providing a second offset liquid production wellbore having a substantially horizontal second offset production length which extends through the reservoir, wherein the second offset production length is laterally offset from the primary production plane by a second production distance on the first side of the primary production plane, and the method may be further comprised of producing the hydrocarbon liquid from the second offset liquid production wellbore.

In some embodiments, the method may be further comprised of providing offset liquid production wellbores in addition to the first offset liquid production wellbore and the second offset liquid production wellbore.

In some embodiments, a substantially symmetrical configuration of wellbores may be provided in which offset production lengths are laterally offset from the primary production plane on both sides of the primary production plane and in which the offset production lengths on both sides of the primary production plane are laterally offset from the primary production plane by substantially similar distances.

As a non-limiting example, and as described for the system of the invention, the first offset production length and the second offset production length may be provided on the first side of the primary production plane, and a third offset production length and/or a fourth offset production length may be provided on a second side of the primary production plane. The first offset liquid production wellbore and the third offset liquid production wellbore may comprise a first set of offset liquid production wellbores, and the second offset liquid production wellbore and the fourth offset liquid production wellbore may comprise a second set of offset liquid production wellbores.

Where offset liquid production wellbores are provided, the method of the invention may be performed in a staged manner in which the production of the hydrocarbon liquid begins along the primary production plane and moves away from the primary production plane as the combustion of the hydrocarbons in the reservoir progresses.

The method of the invention may be performed in a substantially symmetrical staged manner by producing the hydrocarbon liquid on both sides of the primary production plane or in a non-symmetrical manner by producing the hydrocarbon liquid on a single side of the primary production plane.

In a first stage, the injection gas may be injected into the reservoir along the injection line and the hydrocarbon liquid may be produced from the primary liquid production wellbore (i.e., along the primary production plane). Gases contained in the reservoir (such as, for example, gases produced from the combustion of the hydrocarbons, unreacted injection gas and/or natural gas) may be vented from one or more venting positions which are substantially within the primary production plane or laterally offset from the primary production plane by relatively small distances.

In a second stage, the injection gas may be injected into the reservoir along the injection line and the hydrocarbon liquid may be produced from the primary liquid production wellbore and from a first set of offset liquid production wellbores. The first set of offset liquid production wellbores may comprise a single offset liquid production wellbore having an offset production length which is laterally offset from the primary production plane by a relatively small distance on one side of the primary production plane (for a non-symmetrical configuration) or may comprise a pair of offset liquid production wellbores having offset production lengths which are each laterally offset from the primary production plane by a relatively small distance on both sides of the primary production plane (for a symmetrical configuration). Gases contained in the reservoir (such as, for example, gases produced from the combustion of the hydrocarbons, unreacted injection gas and/or natural gas) may be vented from the same venting positions used in the first stage, and/or from other venting positions which are laterally offset from the primary production plane by a greater distance than those used in the first stage. Some gases may also be vented from the first set of offset liquid production wellbores.

In a third stage, production of the hydrocarbon liquid from the primary liquid production wellbore may cease upon detection of a threshold amount of a breakthrough gas at the primary liquid production wellbore.

In a fourth stage, the injection gas may be injected into the reservoir along the injection line and the hydrocarbon liquid may be produced from the first set of offset liquid production wellbores and from a second set of offset liquid production wellbores. The second set of offset liquid production wellbores may comprise a single offset liquid production wellbore having an offset production length which is laterally offset from the primary production plane by a greater distance than the first set of offset liquid production wellbores on one side of the primary production plane (for a non-symmetrical configuration) or may comprise a pair of offset liquid production wellbores having offset production lengths which are each laterally offset from the primary production plane by a greater distance than the first set of offset liquid production wellbores on both sides of the primary production plane (for a symmetrical configuration). Gases contained in the reservoir (such as, for example, gases produced from the combustion of the hydrocarbons, unreacted injection gas and/or natural gas) may be vented from the same venting positions used in the second stage, and/or from other venting positions which are laterally offset from the primary production plane by a greater distance than those used in the second stage. Some gases may also be vented from the sets of offset liquid production wellbores.

In a fifth stage, production of the hydrocarbon liquid from the first set of offset liquid production wellbores may cease upon detection of a threshold amount of a breakthrough gas at the first set of offset liquid production wellbores.

In a sixth stage, the injection gas may be injected into the reservoir along the offset production lengths of the first set of offset liquid production wellbores in order to enhance the delivery of the injection gas toward the second set of offset liquid production wellbores. The injection of the injection gas along the injection line may cease or may continue.

In a seventh stage, some or all of the gases which are vented from the venting positions may be injected into the reservoir along the injection line and/or along the primary production length in order to sequester the gases and/or increase or maintain the reservoir pressure.

In subsequent stages, production of the hydrocarbon liquid may be commenced from additional sets of offset liquid production wellbores having offset production lengths which are laterally offset from the primary production plane by increasing distances (on one side of the primary production plane or on both sides of the primary production plane), and gases may be vented from venting positions which are laterally offset from the primary production plane by increasing distances. As production of the hydrocarbon liquid from progressive sets of offset liquid production wellbores ceases due to detection of threshold amounts of the breakthrough gas, these sets of offset liquid production wellbores may be used for injection of the injection gas and may subsequently be used for injection of gases which are vented from the venting positions.

As an alternative or in addition to using the offset liquid production wellbores for injection of the injection gas, one or more offset injector apparatus may be provided which are laterally offset from the primary production plane and which are associated with one or more of the sets of offset liquid production wellbores. Such offset injector apparatus may be configured in a similar manner as the injector apparatus which is associated with the primary liquid production wellbore. The use of offset injector apparatus may be beneficial for ameliorating uneven production of the hydrocarbon liquid amongst and along the liquid production wellbores. Where an offset injector apparatus is provided, it is preferably configured so that it provides an injection line or injection point which is relatively higher in the reservoir than the adjacent production lengths and which is relatively lower in the reservoir than the adjacent venting positions.

BRIEF DESCRIPTION OF DRAWINGS

Embodiments of the invention will now be described with reference to the accompanying drawings, in which.

DETAILED DESCRIPTION

The present invention is a system and a method for recovering hydrocarbons from a reservoir containing hydrocarbons by in-situ combustion (ISC).

The system may be configured, and the method may be performed in a single stage or in a plurality of stages. The system may be configured, and the method may be performed, in a substantially symmetrical manner or in a non-symmetrical manner relative to the primary production plane, depending upon a configuration of offset liquid production wellbores.

Figure 1:
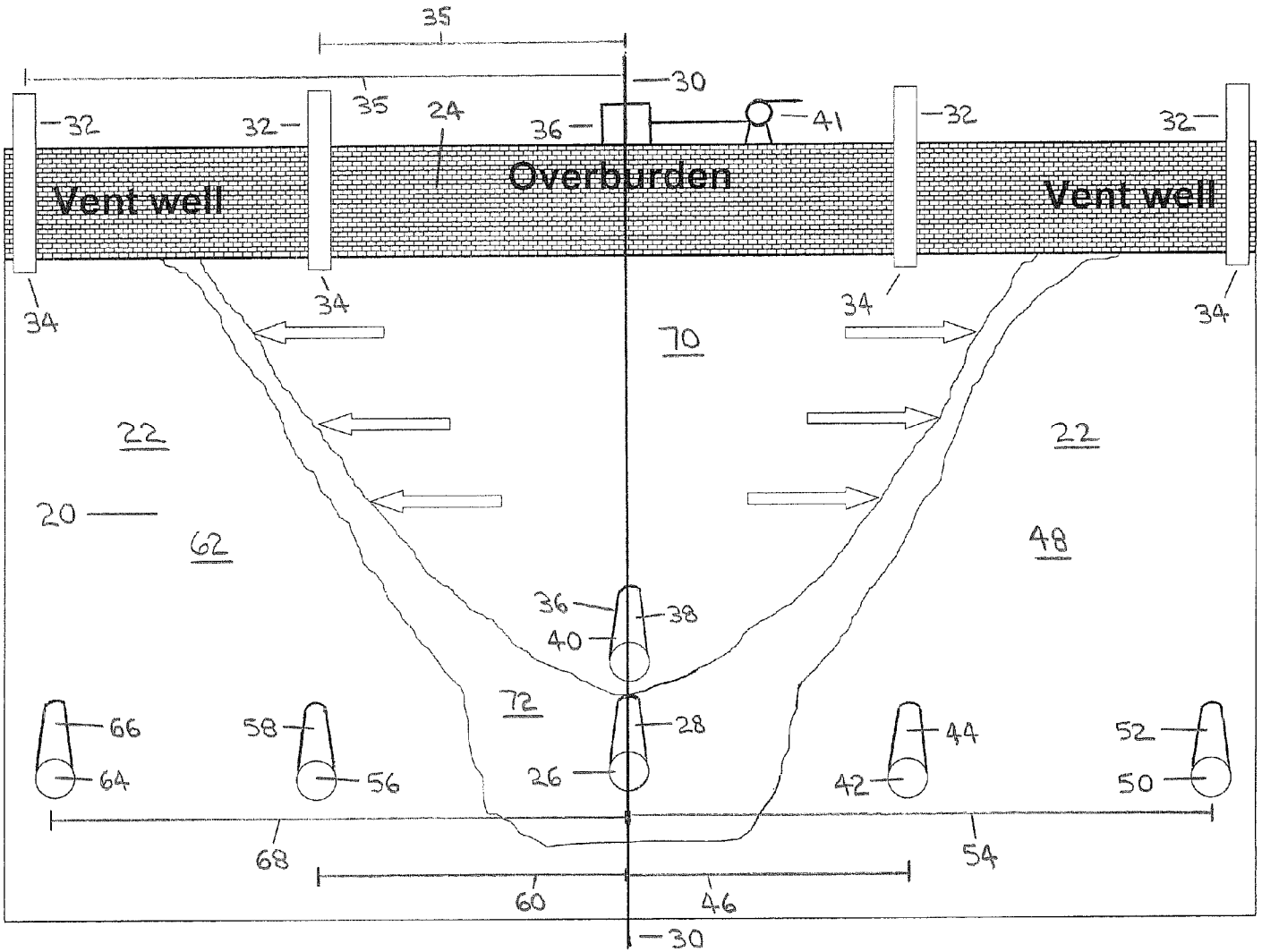
FIG. 1 is a schematic cross-section view of a system for recovering a hydrocarbon liquid from a reservoir according to one embodiment of the invention which includes a symmetrical configuration of offset liquid production wellbores.
Figure 2:
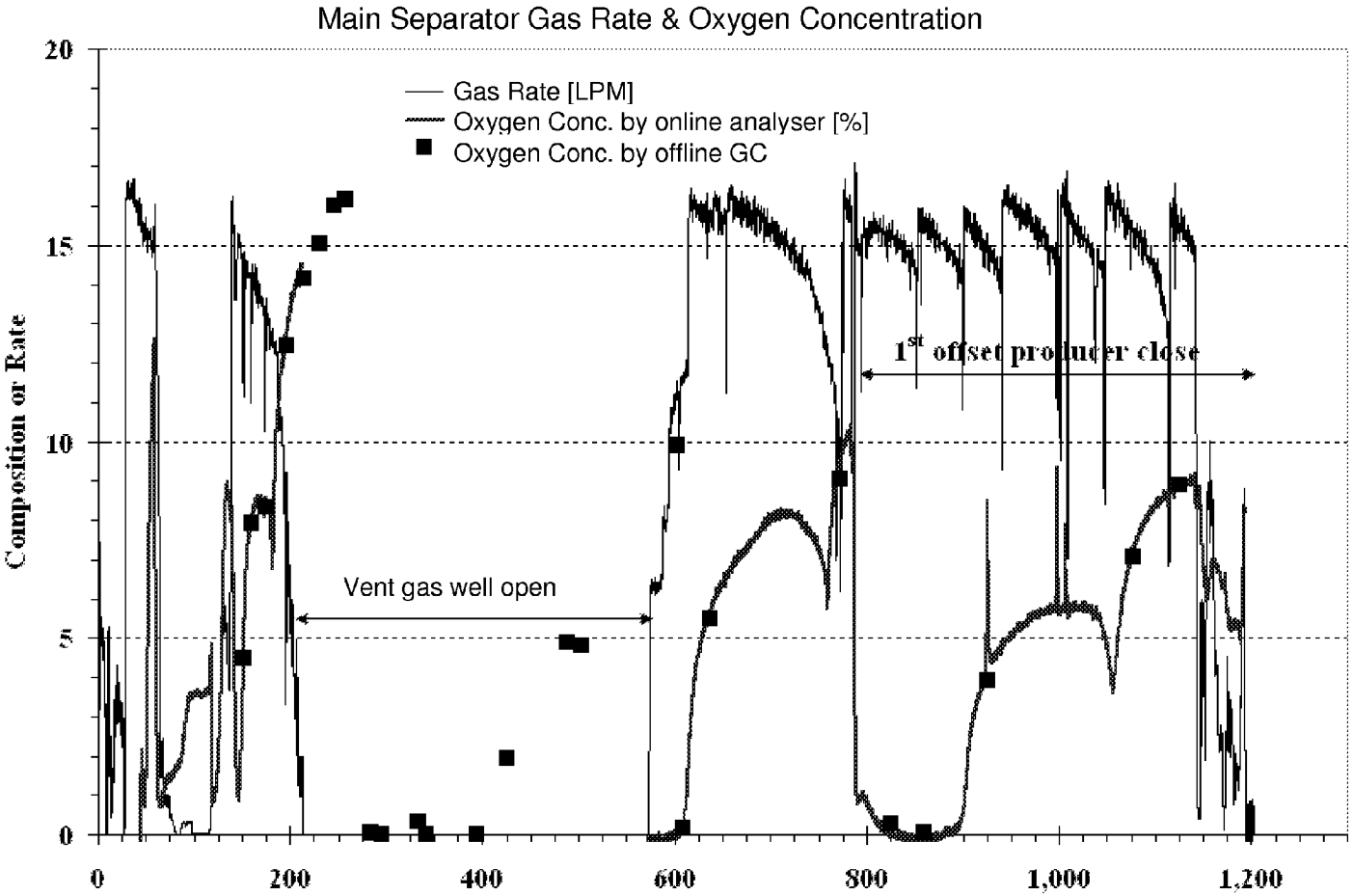
FIG. 2 is a graph depicting gas production rate and oxygen concentration in produced gas from a primary liquid production wellbore, for a three-dimensional laboratory test (Test 2) of the method of the invention.
Figure 3:
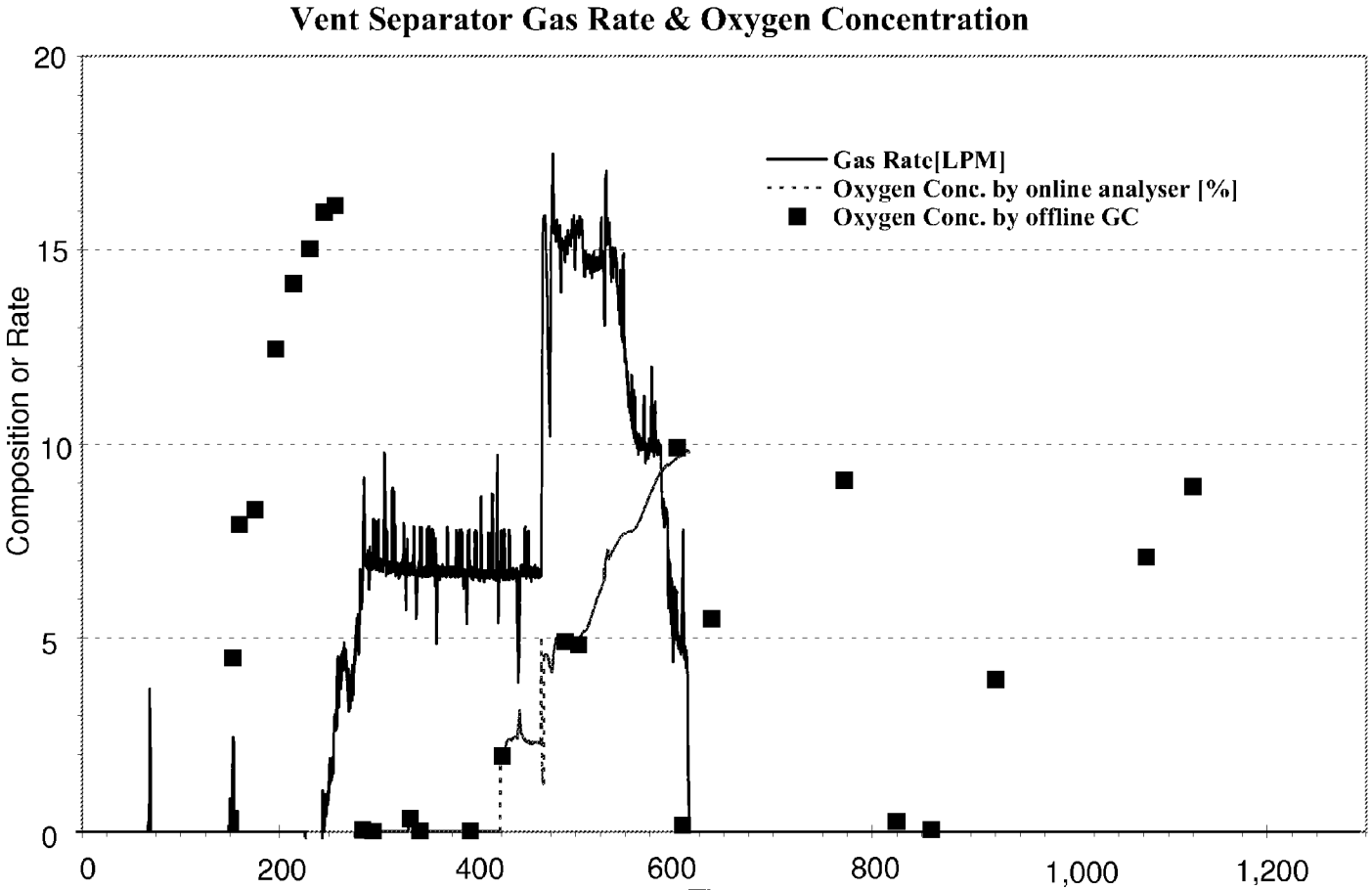
FIG. 3 is a graph depicting gas production rate and oxygen concentration in produced gas from a vent well, for a three-dimensional laboratory test (Test 2) of the method of the invention.
Figure 4:
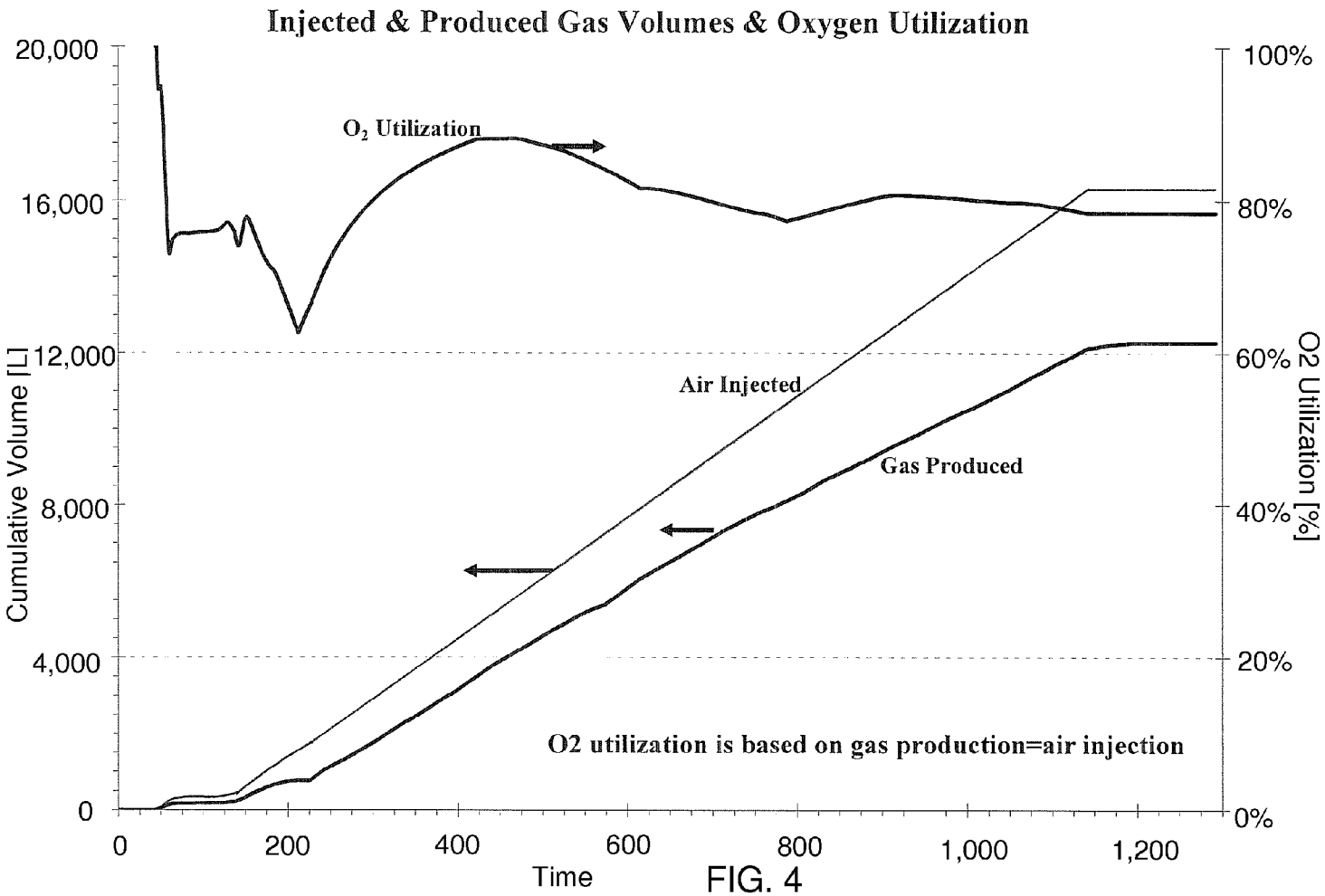
FIG. 4 is a graph depicting injection gas volumes, gas production volumes, and oxygen utilization, for a three-dimensional laboratory test (Test 2) of the method of the invention.
Figure 5:
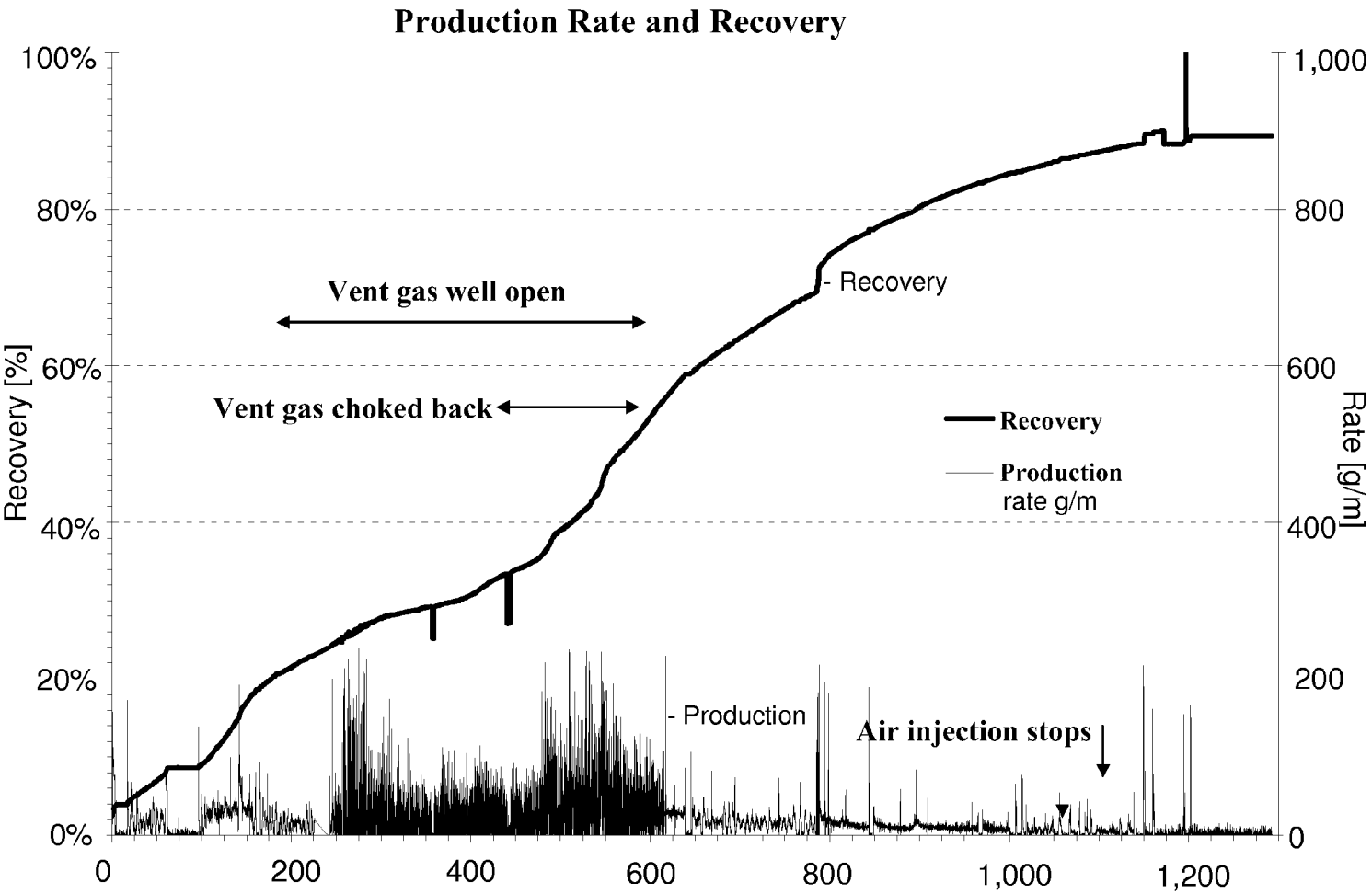
FIG. 5 is a graph depicting estimated oil production rates and recovery factors, for a three-dimensional laboratory test (Test 2) of the method of the invention.
Figure 6:
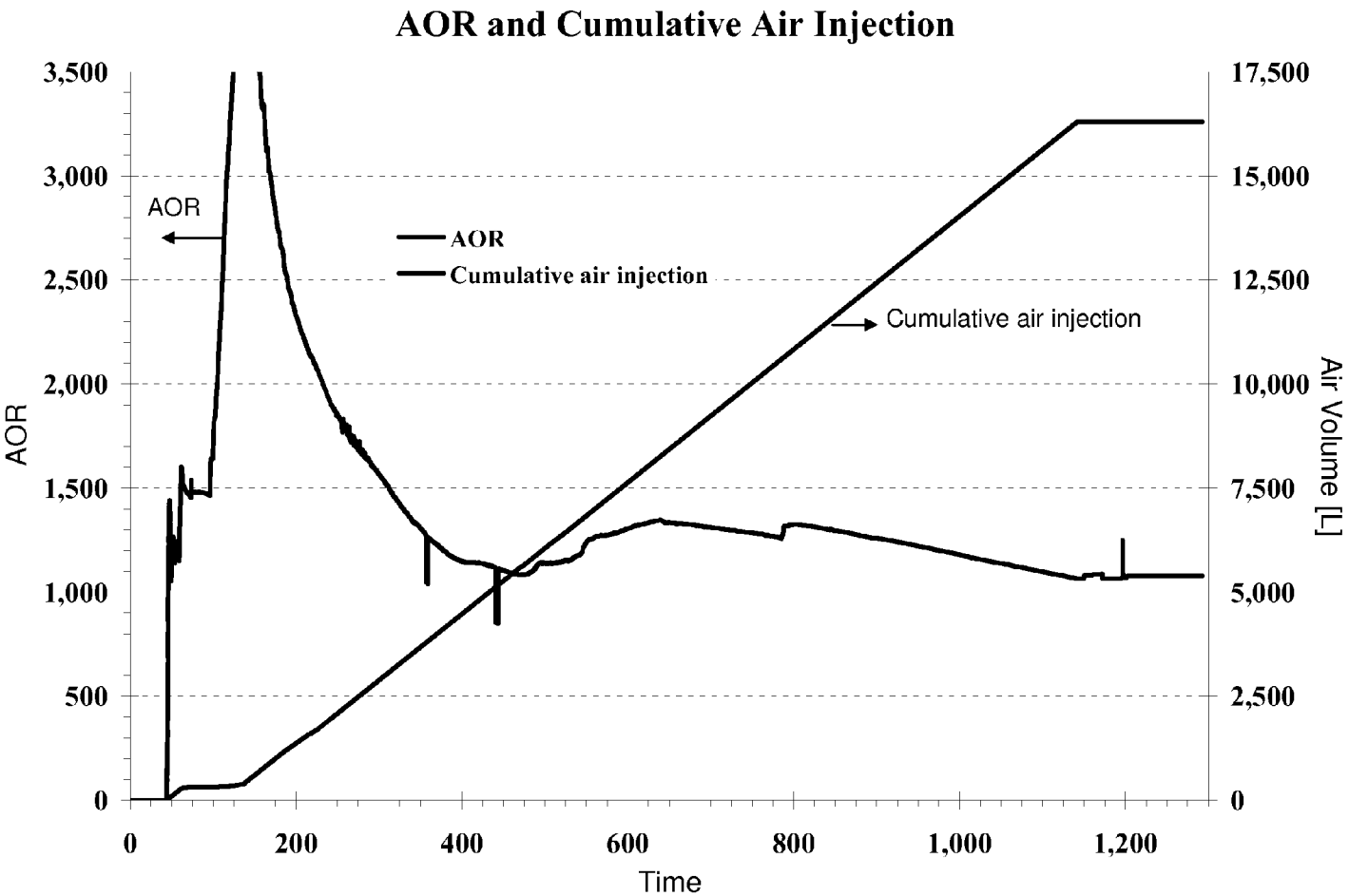
FIG. 6 is a graph depicting cumulative injected oxygen to oil produced ratio (OOR) and cumulative volume of injected gas, for a three-dimensional laboratory test (Test 2) of the method of the invention.

Referring to FIG. 1, there is depicted a schematic cross-section view of a system (20) according to one embodiment of the invention which includes a symmetrical configuration of offset liquid production wellbores which may be used in a staged performance of the method of the invention.

The system (20) is installed in a subterranean environment. As depicted in FIG. 1, the subterranean environment includes a subterranean reservoir (22) containing hydrocarbons. An overburden (24) is located above the reservoir (22). An underburden (not shown) is located below the reservoir (22).

A primary liquid production wellbore (26) penetrates the reservoir (22). The primary liquid production wellbore (26) has a substantially horizontal primary production length (28) which extends through the reservoir (22). The primary production length (28) is positioned substantially within a vertical primary production plane (30).

A plurality of vent wells (32) are in fluid communication with the reservoir (22) at venting positions (34) in the reservoir (22). The venting positions (34) are relatively higher in the reservoir (22) than the primary production length (28).

As depicted in FIG. 1, the venting positions (34) are laterally offset from the primary production plane (30) on opposite sides of the primary production plane (30) and at varying venting distances (35) from the primary production plane (30), but are arranged generally symmetrically relative to the primary production plane (30).

The vent wells (32) may be vertical wells. Alternatively, the vent wells (32) may be directional wells and/or may include substantially horizontal lengths which extend through the reservoir (22), thereby increasing the venting area provided by the vent wells (32).

An injector apparatus (36) is in fluid communication with the reservoir (22) along an injection line (38) in the reservoir (22). The injection line (38) is a line in the reservoir (22) along which injection of an injection gas takes place.

The injection line (38) is substantially parallel with the primary production plane (30). As depicted in FIG. 1, the injection line is directly above the primary production length (28), and is therefore positioned substantially within the primary production plane (30).

The injection line (38) is provided and/or defined by one or more injection wellbores (40). For example, the injection line (38) may be provided by a substantially horizontal injection length of a single injection wellbore (40), or the injection line (38) may be provided by a plurality of injection wellbores (40), such as a row of vertical wellbores with discrete injection points at their distal ends which together provide the injection line (38).

The injection line (38) extends along at least a portion of the primary production length (28). Preferably the injection line (38) extends along substantially the entire primary production length (28). The injection line (38) is relatively higher in the reservoir (22) than the primary production length (28), and is relatively lower in the reservoir (22) than the venting positions (34).

An injection gas source (41) is connected with the injector apparatus (36). The injection gas source (41) supplies an injection gas (not shown) containing oxygen to the injector apparatus (36) for injecting along the injection line (38) in order to cause combustion of the hydrocarbons contained in the reservoir (22).

The injection gas source (41) may be comprised of a source of air, oxygen enriched air, or some other oxygen containing gas. The injection gas source (41) may be further comprised of a compressor, a pump, or some other apparatus for delivering the injection gas to the injection line (38) and the reservoir (22).

The system (20) may be further comprised of an igniter (not shown) for initiating combustion of the hydrocarbons contained in the reservoir (22) in the presence of the injection gas.

A first offset liquid production wellbore (42) has a first offset production length (44) which extends through the reservoir (22). The first offset production length (44) is laterally offset from the primary production plane (30) by a first production distance (46) on a first side (48) of the primary production plane (30).

A second offset liquid production wellbore (50) has a second offset production length (52) which extends through the reservoir (22). The second offset production length (52) is laterally offset from the primary production plane (30) by a second production distance (54) on the first side (48) of the primary production plane (30).

A third offset liquid production wellbore (56) has a third offset production length (58) which extends through the reservoir (22). The third offset production length (58) is laterally offset from the primary production plane (30) by a third production distance (60) on a second side (62) of the primary production plane (30).

A fourth offset liquid production wellbore (64) has a fourth offset production length (66) which extends through the reservoir (22). The fourth offset production length (66) is laterally offset from the primary production plane (30) by a fourth production distance (68) on the second side (62) of the primary production plane (30).

The second production distance (54) is greater than the first production distance (46). The fourth production distance (68) is greater than the third production distance (60). The first offset liquid production wellbore (42) and the third offset liquid production wellbore (56) comprise a first set of offset liquid production wellbores. The second offset liquid production wellbore (50) and the fourth offset liquid production wellbore (64) comprise a second set of offset liquid production wellbores.

As depicted in FIG. 1, the first production distance (46) and the third production distance (60) are substantially equal, and the second production distance (54) and the fourth production distance (68) are substantially equal, with the result that the configuration of the system (20), including the offset production lengths (44, 52, 58, 66), is substantially symmetrical.

The injection line (38) is relatively higher in the reservoir (22) than the offset production lengths (44, 52, 58, 66). As depicted in FIG. 1, the offset production lengths (44, 52, 58, 66) are substantially parallel with the primary production plane (30) and are at substantially the same level in the reservoir (30) as the primary production length (28).

As depicted in FIG. 1, the venting distances (35) for the venting positions (34) substantially correspond with the production distances (46, 54, 60, 68).

As a non-limiting example illustrating a configuration of the system (20) of the invention, assuming a reservoir (22) element having a width of about one hundred (100) meters, a length of about one thousand (1000) meters and a thickness of about twenty (20) meters, the first production distance (46) and the third production distance (60) may each be about fifty (50) meters, and the second production distance (54) and the fourth production distance (68) may each be about one hundred (100) meters. Similarly, venting positions (34) may coincide with the production distances (46, 54, 60, 68) so that the venting distances are about fifty (50) meters and about one hundred (100) meters.

The method of the invention may be performed using the system (20) of the invention, or may be performed using some other system which is suitable for performing the method of the invention. In the description of the method that follows, the method is performed using a system (20) substantially as depicted in FIG. 1 and substantially as described above.

The method of the invention is comprised of injecting an injection gas containing oxygen into the reservoir (22) along the injection line (38) in order to cause combustion of the hydrocarbons contained in the reservoir (22), thereby heating the reservoir (22) so that hydrocarbon liquid (not shown) drains toward the primary liquid production wellbore (26). The method of the invention further comprises producing the hydrocarbon liquid from the primary liquid production wellbore (26) and venting from the vent wells (32), gases produced from the combustion of the hydrocarbons.

The method may be preceded by or may be further comprised of pre-treating the reservoir (22) before injecting the injection gas into the reservoir (22). The pre-treating may be performed in order to enhance the injectivity of the injection gas into the reservoir (22), in order to mobilize the hydrocarbons located adjacent to the injection line (38) and the primary production length (28), in order to heat the hydrocarbons to facilitate combustion, or for some other purpose directed at conditioning the reservoir (22) for performance of the method.

In some embodiments, the method of the invention is preceded by or is further comprised of pre-treating the reservoir (22) by injecting steam into the reservoir (22) along the injection line (38) for a steam injection period, before injecting the injection gas into the reservoir (22).

The steam injection may be continued until fluid communication between the injection line (38) and the primary production length (28) is established and/or until a small steam chamber is formed above the injection line (38). This pre-treating of the reservoir (22) helps to minimize countercurrent flows between the injection gas and the heated hydrocarbon liquid, and helps to minimize combustion of hydrocarbons in the immediate vicinity of the injection line (38) and the primary production length (28).

Ideally the steam injection continues until a steam chamber has formed which is hot enough and large enough to provide a chamber interface along which the hydrocarbon liquid may drain.

Following the pre-treating of the reservoir (22), a first stage of the method may be initiated by commencing injection of the injection gas into the reservoir (22). To assist in initiating combustion of the hydrocarbons in the reservoir (22), an igniter may be provided adjacent to the injection line (38).

The injection gas is supplied to the injector apparatus (36), including the injection wellbores (40), via the injection gas source (41). The injection gas is air or some other suitable oxygen containing gas.

As combustion of the hydrocarbons in the reservoir (22) progresses, a combustion zone (70) forms and expands from the injection line (38), generally away from the primary production plane (30) and upward toward the venting positions (34). As a result, the vent wells (32) assist in the progression of the combustion zone (70) away from the injection line (38) and in influencing the flow of the injection gas through the reservoir (22) away from the primary production length (28).

In addition, as a result of the steam injection and/or as combustion of the hydrocarbons in the reservoir (22) progresses, and as the hydrocarbon liquid drains downward toward the primary production length (28), a pool (72) of hydrocarbon liquid may form around the primary production length (28). Meanwhile, gases contained in the reservoir (22) (such as, for example, gases produced from the combustion of the hydrocarbons, unreacted injection gas and/or natural gas) may move toward the venting positions (34), particularly the venting positions (34) which are substantially within the primary production plane (30) or which are laterally offset from the primary production plane (30) by relatively small distances.

Consequently, due to the configuration of the vent wells (32) and the gravity stabilizing effect resulting from the downward draining of the hydrocarbon liquid toward the primary production length (28), the likelihood of early breakthrough or fingering of the injection gas or combustion gases is reduced. The likelihood of early breakthrough or fingering of gases at the primary production length (28) may be further reduced by controlling the drawdown pressure along the primary production length (28).

The production life of the method and the drainage area of hydrocarbons from the reservoir (22) is enhanced through the use of the offset liquid production wellbores (42, 50, 56, 64).

In a second stage of the method, the hydrocarbon liquid is produced from the primary liquid production wellbore and from the first set of offset liquid production wellbores (consisting of the first offset liquid production wellbore (42) and the third offset liquid production wellbore (56)). During the second stage of the method, the injection gas continues to be injected along the injection line (38) while the hydrocarbon liquid is produced from the primary liquid production wellbore (26), the first offset liquid production wellbore (42) and the third offset liquid production wellbore (56). Gases contained in the reservoir (22) (such as, for example, gases produced from the combustion of the hydrocarbons, unreacted injection gas and/or natural gas) are vented through the same venting positions (34) as in the first stage and/or from other venting positions (34) which are laterally offset from the primary production plane (30) by a greater distance from those from which venting occurred in the first stage. Gases may also be vented through the offset liquid production wellbores (42,56).

In a third stage of the method, production of the hydrocarbon liquid from the primary liquid production wellbore (26) ceases upon detection of a threshold amount of a breakthrough gas at the primary liquid production wellbore (26). As a non-limiting example, the threshold amount of the breakthrough gas may be comprised of any amount of oxygen.

Following ceasing of production from the primary liquid production wellbore (26), the formation of the combustion zone (70) and the pool (72) of hydrocarbon liquid may tend to accelerate away from the primary production plane (30), which may result in an increase in the production rate of the hydrocarbon liquid from the first set of offset liquid production wellbores (42,56). As the combustion zone (70) and the pool (72) of hydrocarbon liquid approach the first set of offset liquid production wellbores (42,56), the method may progress to a fourth stage.

In a fourth stage of the method, the hydrocarbon liquid is produced from the first set of offset liquid production wellbores (consisting of the first offset liquid production wellbore (42) and the third offset liquid production wellbore (56)) and from the second set of offset liquid production wellbores (consisting of the second offset liquid production wellbore (50) and the fourth offset liquid production wellbore (64)). During the fourth stage of the method, the injection gas continues to be injected along the injection line (38) while the hydrocarbon liquid is produced from the offset liquid production wellbores (42, 50, 56, 64). Gases contained in the reservoir (22) (such as, for example, gases produced from the combustion of the hydrocarbons, unreacted injection gas and/or natural gas) are vented through the same venting positions (34) as in the second stage and/or from other venting positions (34) which are laterally offset from the primary production plane (30) by a greater distance from those from which venting occurred in the second stage. Gases may also be vented through the offset liquid production wellbores (42, 50, 56, 64).

In a fifth stage of the method, production of the hydrocarbon liquid from the first set of offset liquid production wellbores (42,56) ceases upon detection of a threshold amount of a breakthrough gas at the first set of offset liquid production wellbores (42,56). As a non-limiting example, the threshold amount of the breakthrough gas may be comprised of any amount of oxygen.

In a sixth stage of the method, the injection gas may be injected into the reservoir along the offset production lengths (44,52) of the first set of offset liquid production wellbores (42,56), while injection of the injection gas into the reservoir (22) along the injection line (38) either ceases or continues.

In a seventh stage of the method, some or all of the gases vented from the vent wells (32) may be injected into the reservoir (22) along the injection line (38) and/or along the primary production length (28) in order to sequester the gases and/or increase or maintain the pressure in the reservoir (22).

1. Laboratory Testing of the Invention

Two separate laboratory tests (Test 1 and Test 2) were conducted for the primary purpose of proving the concept of the invention. Both tests used MacKay River bitumen having a viscosity of 536,000 centipoise at 15° Celsius. In both tests, a sand pack was saturated with dead bitumen. In both tests, a start-up procedure was employed which involved pre-heating of the reservoir (22) with electrical heaters and injection of nitrogen gas to create a hot depleted zone adjacent to the injection line (38) and the primary liquid production wellbore (26).

Test 1 utilized a model which included a two-dimensional rectangular vessel measuring 60 centimeters wide by 30 centimeters deep by 10 centimeters long, packed with 20/40 silica sand in order to provide a permeability of 110 Darcies. The model further included a single horizontal injection wellbore (40), a primary liquid production wellbore (26), a first set of offset liquid production wellbores consisting of a first offset liquid production wellbore (42), a second set of offset liquid production wellbores consisting of a second offset liquid production wellbore (50), and two vent wells (32). A single separator/back pressure regulator was used to control each of the liquid production wellbores (26,42,50) and the vent wells (32).

In Test 1, combustion was initiated, but was sustained for only about one hour. The heat loss from the large surface area of the two-dimensional model was significant, and is believed to have adversely affected the development and propagation of the combustion zone (70). No residual oil was observed to be remaining in the combustion zone (70) following combustion.

Test 2 utilized a model which included a cylindrical three-dimensional vessel measuring 36 centimeters in diameter and 60 centimeters long, packed with sand in order to provide a permeability of 20 Darcies. The model further included a single horizontal injection wellbore (40), a primary liquid production wellbore (26), a first set of offset liquid production wellbores consisting of a first offset liquid production wellbore (42), a second set of offset liquid production wellbores consisting of a second offset liquid production wellbore (50), and two vent wells (32). The pressures in the liquid production wellbores (26,42,50) and in the vent wells (32) were independently controllable.

In Test 2, a constant air injection rate of 16 liters per minute was used, while the drawdown pressures of the wellbores (26, 32, 42, 50) were adjusted and controlled in order to direct the development and movement of the combustion zone (70) and in order to control the production of breakthrough gas at the wellbores (26,42,50). In Test 2, combustion was sustained for longer than 1200 minutes.

Referring to FIGS. 2-6, the following observations were noted from Test 2:

1. opening the vent wells (32) appeared to direct the development of the combustion zone (70) upward toward the vent wells (32);
2. opening the vent wells (32) resulted in no breakthrough gas being produced at the liquid production wellbores (26,42,50);
3. opening the second offset liquid production wellbore (50) caused a drop in the amount of breakthrough gas which was produced at the primary liquid production wellbore (26) and the first offset liquid production wellbore (42);
4. the oxygen concentration in the gases vented from the vent wells (32) dropped to zero or near zero initially upon opening of the vent wells (32), but increased gradually over time;
5. oxygen utilization reached 78% by the end of Test 2;
6. the final recovery of oil from the model in Test 2 was estimated to be approximately 90%, including oil recovered during the pre-heating;
7. the production of hydrocarbon liquid from the liquid production wellbores (26,42,50) was unsteady and fluctuating while the vent wells (32) were open;
8. the oil production rate was lower when the vent wells (32) were open, suggesting that gas drive toward the liquid production wellbores (26,42,50) may contribute to oil production rates;
9. the cumulative injected air to oil produced ratio (OOR) in Test 2 exhibited a decreasing trend, suggesting that combustion became more efficient over the course of Test 2, with the final OOR being about 1,100;
10. the compression energy to oil produced ratio in Test 2 was about 2.1 GJ/$m^3$, which is approximately equivalent to the energy required for a steam assisted gravity drainage (SAGD) process involving a cumulative steam to oil produced ratio (SOR) of about 0.9.

In summary, Test 1 and Test 2 appeared to demonstrate that low heat loss is very important for a successful test of ISC processes, having regard to the poor results obtained from the model of Test 1, which included a two-dimensional vessel. Test 2 appeared to demonstrate that the method of the invention is feasible and may be characterized by relatively high oil recovery, relatively high oxygen utilization, and relatively low cumulative injected oxygen to oil produced ratio (OOR).

2. Numerical Simulation of the Method of the Invention

A top-down process ISC process has been disclosed in "Experimental and Numerical Simulations of a Novel Top Down In-Situ Combustion Process", Coates, R., Lorimer, S., Ivory, J., Society of Petroleum Engineers, SPE 30295, 1995 and elsewhere.

Several physical model laboratory experiments of the top-down ISC process have been carried out in the past (Coates R, Lorimer S. and Ivory J., Experimental and Numerical Simulations of a Novel Top Down In-Situ Combustion process, SPE 30295 presented at International Heavy oil Symposium, Calgary, Alberta, Can., Jun. 19-21, 1995; Coates R., Revisiting Top Down In Situ Combustion—An Alternative Bitumen Recovery Process, presented at Canadian Heavy Oil Association Slugging It Out Conference, Calgary, Alberta, Apr. 10, 2006.).

These experiments have demonstrated the technical feasibility of utilizing the advantages of ISC as a primary process for recovery of Athabasca bitumen. Under conditions where gravitational force dominates, stable advancement of the combustion front from the top to the bottom of the reservoir was achieved.

A simulation study of the present invention was carried out with the STARS™ (Steam, Thermal and Advanced Processes Reservoir Simulator) thermal simulator developed by Computer Modelling Group Ltd. (CMG). The simulation study was aimed at relatively thin Athabasca reservoirs (about 20 meters thick). A history match of the results of the top-down ISC experiment was done to validate the model proposed for the simulation study. Properties of a virgin Athabasca reservoir were employed, including a published kinetic reaction model (Belgrave, J. D. M., Moore, R. G., Ursenbach, M. G., and Bennion, D. W., A Comprehensive Approach to In Situ Combustion Modeling, paper presented to the SPE/DOE Seventh Symposium on EOR held in Tulsa, Okla., Apr. 22-25, 1990.) which was developed from combustion tube tests of Athabasca oil sands.

(a) History Match of the Laboratory Results

Results of a scaled physical laboratory experiment of the top-down ISC process were applied to validate the simulation model. The experiment was carried out in a cylindrical sand pack, 29 centimeters in diameter and 40 centimeters in height, for investigating the top-down ISC process where the gravitational force was scaled to be dominant over the capillary force. The sand pack consisted of 40-70 mesh sand and had a measured permeability of approximately 60 Darcies and porosity of 0.33. The sand pack was saturated with dead Athabasca bitumen to an initial oil saturation of 0.9. A grid of thermocouples was installed to track the combustion front and an external guard heater assembly was commissioned to negate heat losses.

In preparation for injection of air as an injection gas, the sand pack was pre-heated for about 9 hours with a central steam heater 24 centimeters long, which provided localized pre-heating near the injection region but limited pre-heating the entire pack to prevent premature drainage of the bitumen. At the end of the pre-heating, enriched air containing 50% oxygen was injected to the top of the vessel, while oil and gas were produced from a 20 cm horizontal well located at the vessel bottom. The test lasted about 22 hours, including the pre-heating time.

(b) The Simulation Model

The CMG STARS™ based model consists of seven fluid components: water, maltene, asphaltene, $N_2$, $CO_2$, $O_2$, and coke. In the model, Athabasca bitumen is characterized by a two pseudo-component mixture: 91.5 mole % maltene and 8.5 mole % asphaltene. The model includes the combustion reactions of the pseudo-components proposed by Belgrave and Moore. This reaction model is based upon experimental studies of thermal cracking reactions and low temperature oxidation of Athabasca bitumen, and published data for the high temperature oxidation of coke. The model allows bitumen to undergo density and viscosity increases, as well as reduced reactivity to oxidation, with increased oxidation presence. The reaction types utilized by the model were as follows:

Thermal Cracking Reactions

1. Maltenes→0.372 Asphaltenes
2. Asphaltenes→79.188 Coke
3. Asphaltenes→25.413 Gas Low Temperature Oxidation Reactions 4. Maltenes+3.359 $O_2$→0.473 Asphaltenes
5. Asphaltenes+7.588 $O_2$→101.723 Coke Coke Combustion 6. 0.811 Coke+$O_2$→0.811 Gas+0.46 $H_2O$ Arrhenius Reaction Equation $$dC_r/dt=A_r\exp^{(Er/RT)}C_1^nC_2^m$$

The kinetic rates and heats of reaction for the six reaction types are provided in Table 1, as follows:

TABLE 1

| Reaction | Reaction Frequency Factor ($A_r$) | Activation Energy ($E_r$), J/gmole | Heat Of Reaction, J/gmole |
|---|---|---|---|
| 1 | 7.86E+17 | 2.35E+05 | 0 |
| 2 | 3.51E+14 | 1.77E+05 | 0 |
| 3 | 1.18E+14 | 1.76E+05 | 0 |
| 4 | 1.11E+10 | 8.67E+04 | 1.30E+06 |
| 5 | 3.58E+09 | 1.86E+05 | 2.86E+06 |
| 6 | 1.59E+02 | 3.48E+04 | 3.50E+05 |

The model also provides for a viscosity-temperature relationship of Athabasca bitumen, in which a linear log equation is assumed for the viscosity mixing rule. The relationship indicates very high viscosity of the bitumen at room temperature, about 800,000 centioise, which is nearly seven times higher than that in the Belgrave study. A symmetrical half of the sand pack was modeled with a radial coordinate system having 14 by 7 by 20 grid blocks, for a total of 1,960 blocks. Each of the blocks is 1 centimeter in radial direction and 2 centimeters in height.

(c) Matching of the Laboratory Results

The pre-heating step was simulated by supplying heat to the top 12 central blocks (24 centimeters) to maintain the temperature at 225° C. for about nine hours. The temperature distribution from the simulation at the end of the pre-heating step compares reasonably well with the measured profile. The simulation assumes no heat loss through the side wall of the vessel because the temperature drop across the vessel wall was constantly monitored during the test and reduced by the external guard heater assembly. However, small heat losses could have occurred through the overburden and underburden insulation blocks in the actual experiment and were accounted for in the model.

The actual injection rates of the enriched air and back-pressure of the horizontal well (2.1 MPa) were prescribed in the model. Quality of the match is primarily judged by comparing the measured and model bitumen production. Several simulation runs were made with different relative permeability curves to obtain the match. It is noted that the injection and production volumes from the simulation were multiplied by two for comparing with the laboratory data since only half of the sand pack was modeled. Because the actual air rates were specified, the injection volume from the simulation falls in line with the laboratory data, but occurs only when sufficient bitumen is produced. If not, the air injectivity would be lower than the actual due to insufficient voidage in the sand pack and the constraint of back-pressure imposed on the system.

Analysis of the produced gas composition shows that a small amount of oxygen channelled through the sand pack during the early hours of the injection and near the end of the experiment when the sand pack was almost depleted of oil. The bypass volume was estimated to be about 6% by weight of the injected oxygen. No oxygen bypass is indicated from the simulation results. The cumulative mass ratio of injected oxygen to bitumen produced (OOR) from the simulation is 6.6% lower than that from the experiment (0.28 vs. 0.30). The difference is about the same as the oxygen bypass volume shown in the laboratory test. Given that density of bitumen and oxygen at the standard conditions are 997 g/L and 1.35 g/L respectively, the cumulative volume ratios of OOR and AOR (injected air with 21 volume % $O_2$ to produced oil ratio) from the experiment are 225 and 1,070 respectively. OOR is an indicator for the efficiency of oxygen utilization in the process, very much like injected steam to bitumen produced (SOR) as an indicator for the steam processes.

(d) The Numerical Model for the Invention

The numerical model for studying the method of the invention includes the same kinetic reaction model and fluid properties as that used for the top-down ISC experiments, and the reservoir properties and initial conditions as provided in Table 2.

TABLE 2

| | |
|---|---|
| Reservoir Thickness, m | 20 |
| Reservoir Initial Pressure, MPa | 2 |
| Reservoir Initial Temperature, ° C. | 13 |
| Porosity | 0.33 |
| Absolute Horizontal Permeability, Darcy | 4 |
| Absolute Vertical Permeability, Darcy | 0.4 |
| Water Saturation | 0.15 |
| Oil Saturation | 0.85 |
| GOR | 0 |
| Asphaltene Content in Bitumen, mole % | 8.5 |
| Bitumen Viscosity @ 13° C., mPa s | $2.9 \times 10^6$ |
| Maltene Viscosity @ 13° C., mPa s | $1.2 \times 10^6$ |
| Asphaltene Viscosity @ 13° C., mPa s | $5.5 \times 10^{10}$ |

The reservoir (22) element in the model is 100 m wide, 1,000 m long, and 20 m high. For a two-dimensional simulation, the reservoir is divided into 100×1×20 grid blocks. Reservoir conditions were specified the same as the top-down ISC experiments. The numerical model is a non-symmetrical model in which offset liquid production wellbores (42,50) are located only on one side of the primary production plane (30).

Figure 7:
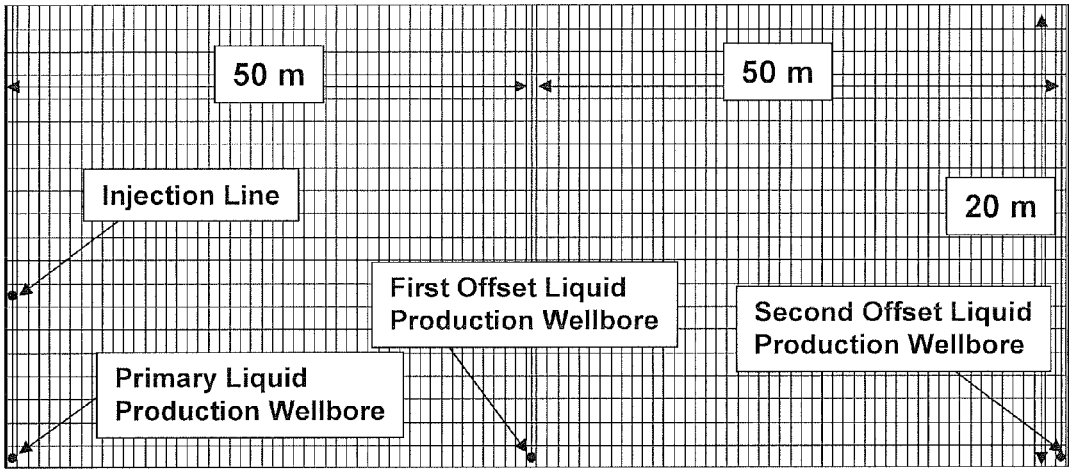
FIG. 7 is a depiction of a non-symmetrical numerical model used in a CMG STARS™ simulation of the method of the invention.

Referring to FIG. 7, a primary liquid production wellbore (26) having a primary production length (28) of one thousand (1000) meters is located at the bottom and left-most block at 7 meters directly below the injection line (38). First and second sets of offset liquid production wellbores (42,50) are laterally offset from the primary production plane (30) by 50 meters and 100 meters respectively. The offset production lengths (44,52) are at the same level in the reservoir (22) as the primary production length (28) and are located on one side of the primary production plane (30). For the purpose of the simulation, the vent wells (32) were excluded from the model so that the results of the simulation could be compared with an analogous steam process using the same system (20) configuration.

The method of the invention was initiated with steam injection into the injection wellbore (40) for 130 days to establish communication between the injection well (40) and the primary liquid production wellbore (26) and to create a small steam chamber. No attempt was made to optimize the start-up procedure, which was followed by injecting 25° C. air containing 21 volume % of oxygen. The bottom-hole pressure of the injection well (40) was maintained constant at 5 MPa, while a drawdown pressure of 200 kPa was maintained at the primary liquid production wellbore (26). If oxygen was detected at the primary liquid production wellbore (26), production therefrom was choked back to maintain an oxygen bypass rate at the primary liquid production wellbore (26) of less than $3\times10^4$ standard $m^3$/day.

All of the offset liquid production wellbores (42,50) were kept open throughout the simulation, with their bottom hole pressures maintained at 200 kPa below the initial reservoir (22) pressure of 2 MPa. The same oxygen bypass constraint which was imposed on the primary liquid production wellbore (26) was imposed on the offset liquid production boreholes (42,50). Production increased dramatically as the combustion zone (70) moved closer to the offset liquid production wellbores (42,50). At these times, an oil rate as high as 2,000 $m^3$/d was observed. Once the combustion zone (70) moved past the first set of offset liquid production wellbores (42), total production dropped until the combustion zone (70) approached the second set of offset liquid production wellbores (50).

For comparison to a similar steam process, a field scale simulation of a multi-stage steam assisted gravity drainage (SAGD) process was performed in an identical reservoir. Three modifications to the simulation model were made for the multi-stage SAGD simulation:

1. air injection was replaced by steam injection,
2. the injection pressure was reduced to 2.5 MPa from 5.0 MPa, and
3. a 15° C. steam trap constraint was imposed on each of the primary liquid production wellbore (26), the first set of offset liquid production wellbores (42) and the second set of offset liquid production wellbores (50).

(e) Simulation Results

The performances of the method of the invention and the multi-stage SAGD process were compared for their production rates, recovery factors, and energy requirements.

Figure 8:
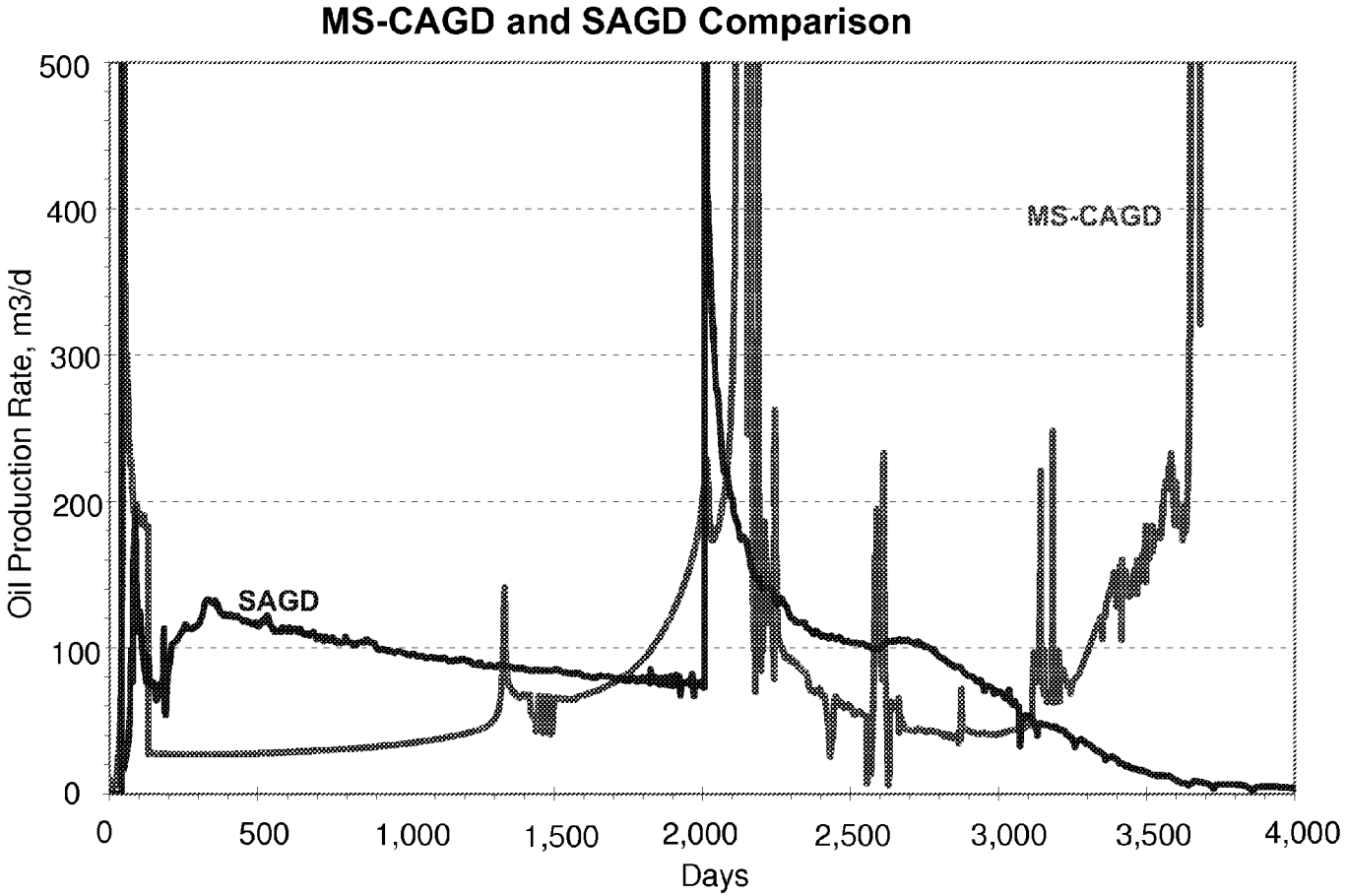
FIG. 8 is a graph comparing the instantaneous oil production rates from a CMG STARS™ simulation of a staged application of the method of the invention and of a staged steam assisted gravity drainage (SAGD) process using a similar system configuration.
Figure 9:
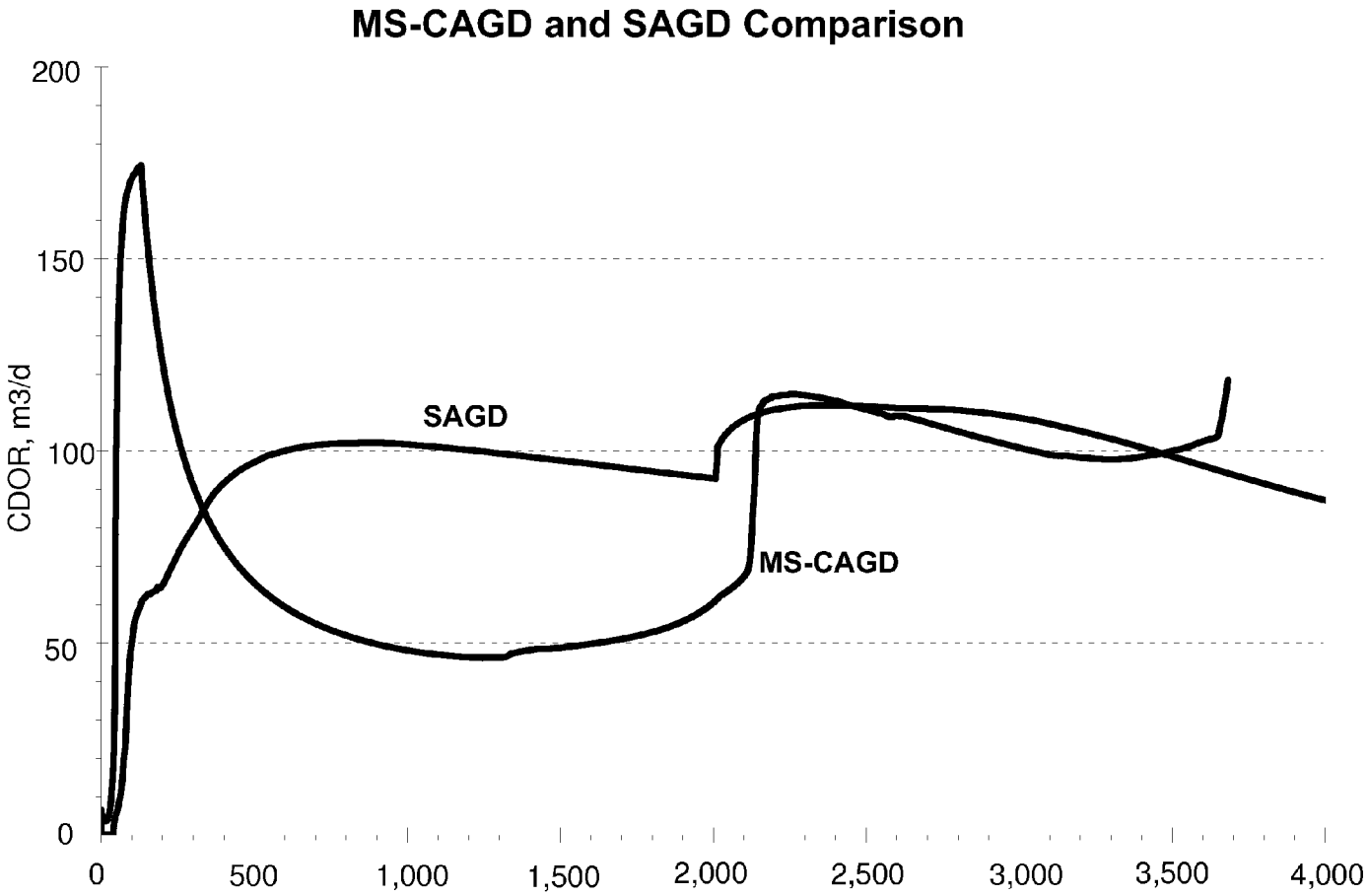
FIG. 9 is a graph comparing the calendar day oil production rates from a CMG STARS™ simulation of a staged application of the method of the invention and of a staged steam assisted gravity drainage (SAGD) process using a similar system configuration.

Instantaneous oil production rates and calendar day oil production rates of the two processes are shown in FIG. 8 and FIG. 9 respectively. The production rates from the multi-stage SAGD process are shown to be higher than that of the method of the invention during the first 4½ years of operation. However, as the combustion zone (70) approaches the first set of offset liquid production wellbores (42), the production rates of the method of the invention pick up significantly, with the calendar day oil production rate of the method of the invention subsequently exceeding that of the multi-stage SAGD process. On day 3,563 of the simulations, the calendar day oil production rate of the method of the invention is 122.1 $m^3$/d as compared to 95.4 $m^3$/d for the multi-stage SAGD process.

For one and a half well pairs in the above model reservoir, as depicted in FIG. 7, the corresponding calendar day oil production rates per well pair for the method of the invention and the multi-stage SAGD process are 81.4 $m^3$/d and 63.6 $m^3$/d respectively. The calendar day oil production rate for the multi-stage SAGD process appears reasonable when compared with the production from a conventional SAGD process for a 20 m thick Athabasca reservoir with a 6.7 hectare well pair spacing.

Figure 10:
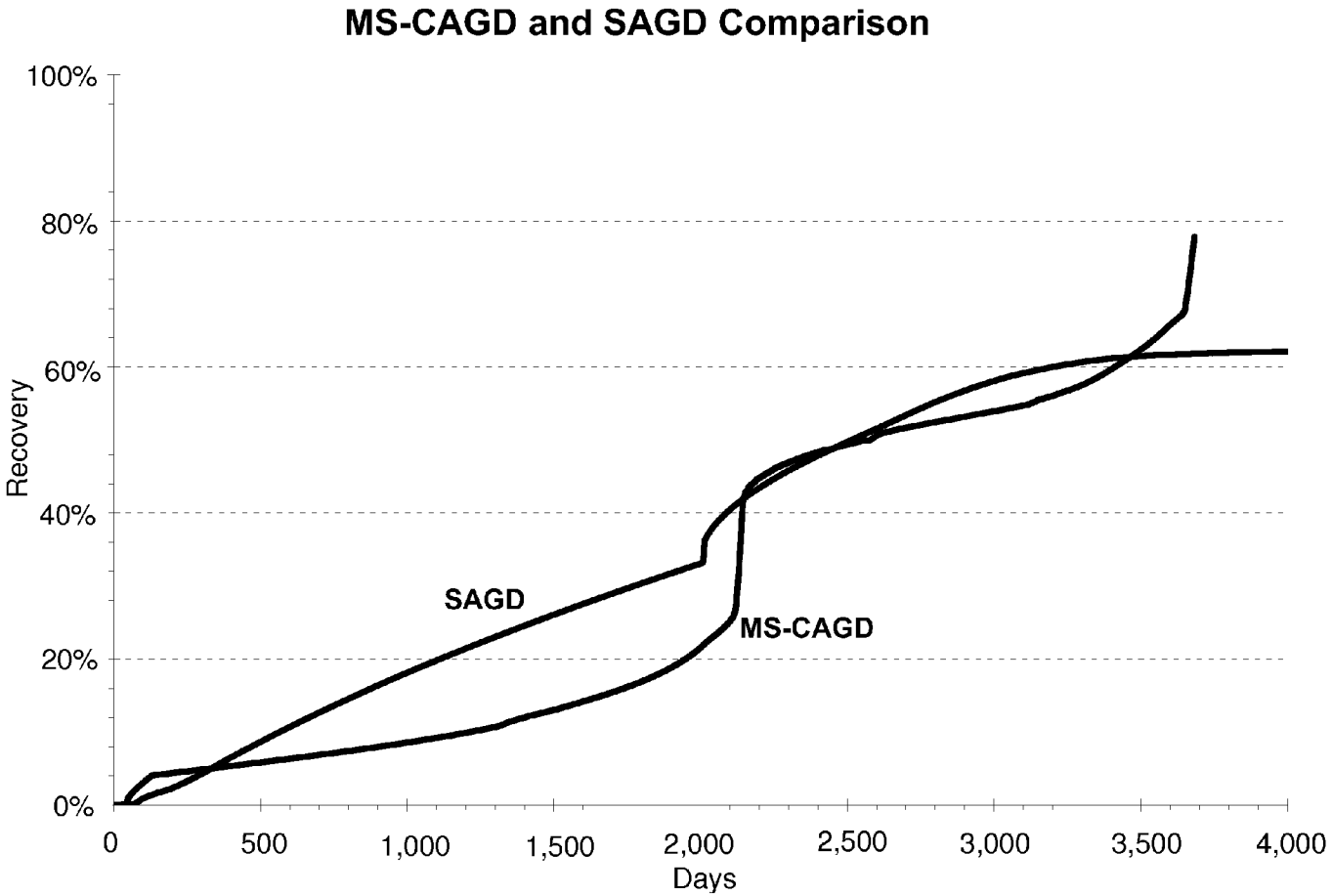
FIG. 10 is a graph comparing the hydrocarbon recovery factors from a CMG STARS™ simulation of a staged application of the method of the invention and of a staged steam assisted gravity drainage (SAGD) process using a similar system configuration.

The reservoir (22) in the simulation model contained $5.61\times10^5$ $m^3$ of original oil in place (OOIP). Referring to FIG. 10, the final recovery factor for the multi-stage SAGD process reaches 61% versus 77.6% for the method of the invention. The residual oil saturation for both cases was set at 20%. As a result, the method of the invention appears to have produced almost all of the recoverable oil which is contained in the reservoir (22).

Figure 11:
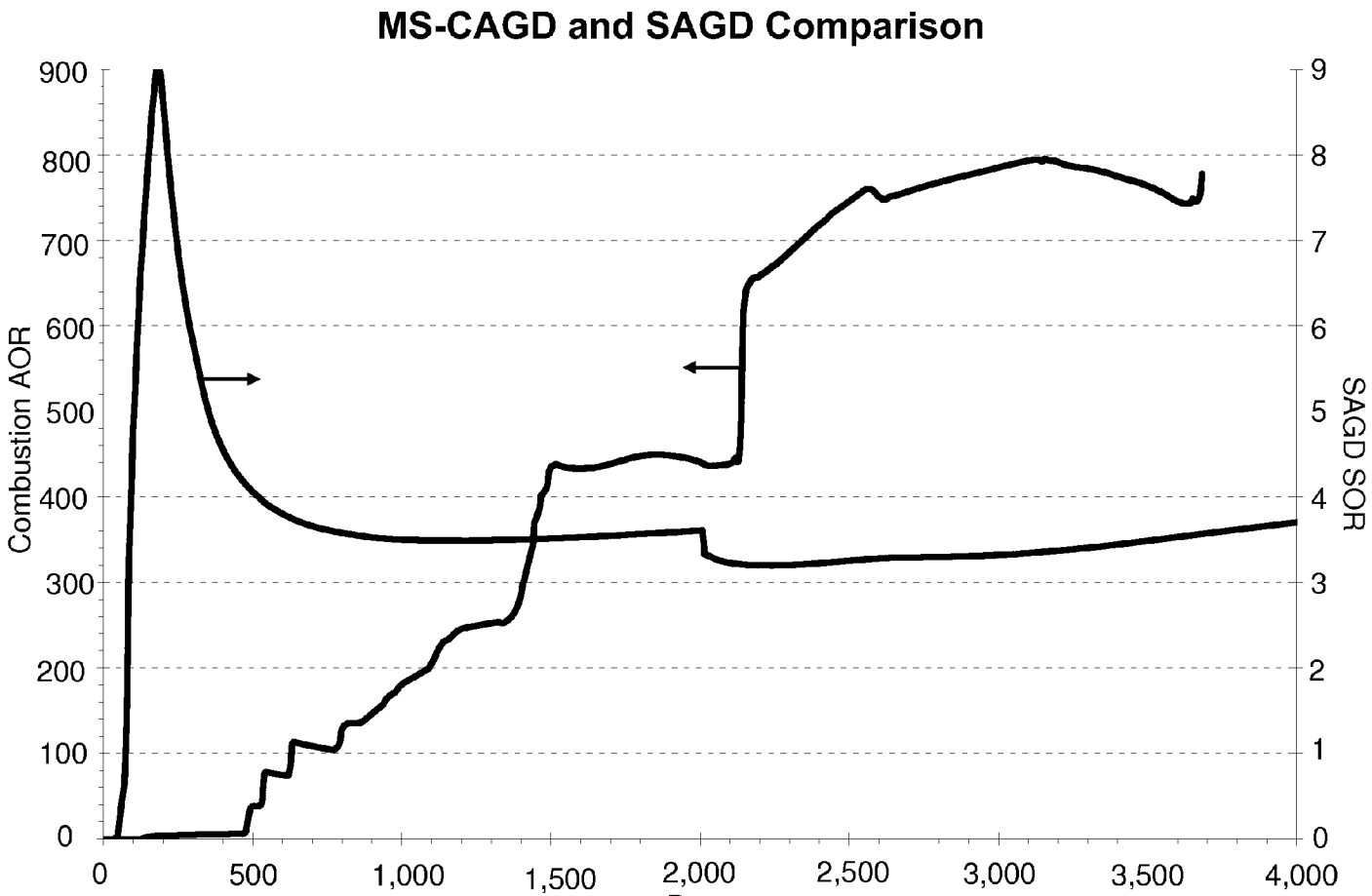
FIG. 11 is a graph comparing the oxygen to produced hydrocarbon (oil) ratio from a CMG STARS™ simulation of a staged application of the method of the invention and of a staged steam assisted gravity drainage (SAGD) process using a similar system configuration.

FIG. 11 depicts the cumulative oxygen to produced oil ratio (OOR) for the method of the invention and the cumulative steam to produced oil ratio (SOR) for the multi-stage SAGD process. The cumulative OOR for the method of the invention begins at a very low value but increases steadily with time, similar to the upward trending behavior seen in the laboratory test. The ratio reached 706 at the end of the simulation run, which was about three times the maximum ratio which was observed in the laboratory test. The cumulative SOR of the multi-stage SAGD process was high during the start-up period, and dropped to 3.2 as the steam interface moved past the first set of offset liquid production wellbores (42). Thereafter, the cumulative SOR climbed gradually to 3.7 on day 3,563 of the simulation.

From the cumulative OOR and the cumulative SOR, one can calculate the energy required for compressing air for the method of the invention, and for generating steam for the multi-stage SAGD process. The data used for the calculations are shown in Table 3 and Table 4.

TABLE 3

| | |
|---|---|
| Air Ambient Pressure, kPa | 100 |
| Air Injection Pressure @ 15° C. | 5000 |
| Compression Ratio | 50 |
| Oxygen/Oil Ratio | 706 |
| Air/Oil Volume Ratio, $m^3/m^3$ | 3362 |
| k = Cp/Cv @ 20° C. | 1.20 |
| Compressor Efficiency, % | 80 |
| Power Generator Efficiency, % | 30 |
| Adiabatic Compression, hp/($m^3$/d oil) | 118.3 |
| Isothermal Compression, hp/($m^3$/d oil) | 83.9 |
| Conversion Factor, GJ/hp-d | 0.0644 |
| Average Compression Energy, GJ/$m^3$ oil | 6.5 |

TABLE 4

| | |
|---|---|
| Steam Vapour Energy @ 10 MPa, GJ/L $m^3$ | 2.725 |
| Steam Condensate Energy @ 10 MPa, GJ/L $m^3$ | 1.408 |
| Steam Quality at Boiler, % | 75.0 |
| Boiler Efficiency, % | 85 |
| Heat Recovery From Hot Condensate, % | 75 |
| Preheated BFW Temperature, ° C. | 120 |
| Energy In Preheated BFW, GJ/$m^3$ | 0.44 |
| Energy to Generate 100% Steam at Plant, GJ/L $m^3$ | 2.83 |
| Steam Quality Drop by Heat Loss, % | 1.0 |
| Steam Quality Drop by Pressure Letdown, % | 5.0 |
| Energy to Generate 100% Steam at WH, GJ/Liq. $m^3$ | 3.01 |
| SOR | 3.7 |
| Energy Consumption, GJ/$m^3$ oil | 11.1 |

The calculations show that the compression energy requirement over the life of the method of the invention is 6.5 GJ/$m^3$ of bitumen produced. This is 71% lower than the 11.1 GJ/$m^3$ of bitumen produced for the multi-stage SAGD process.

Figure 12:
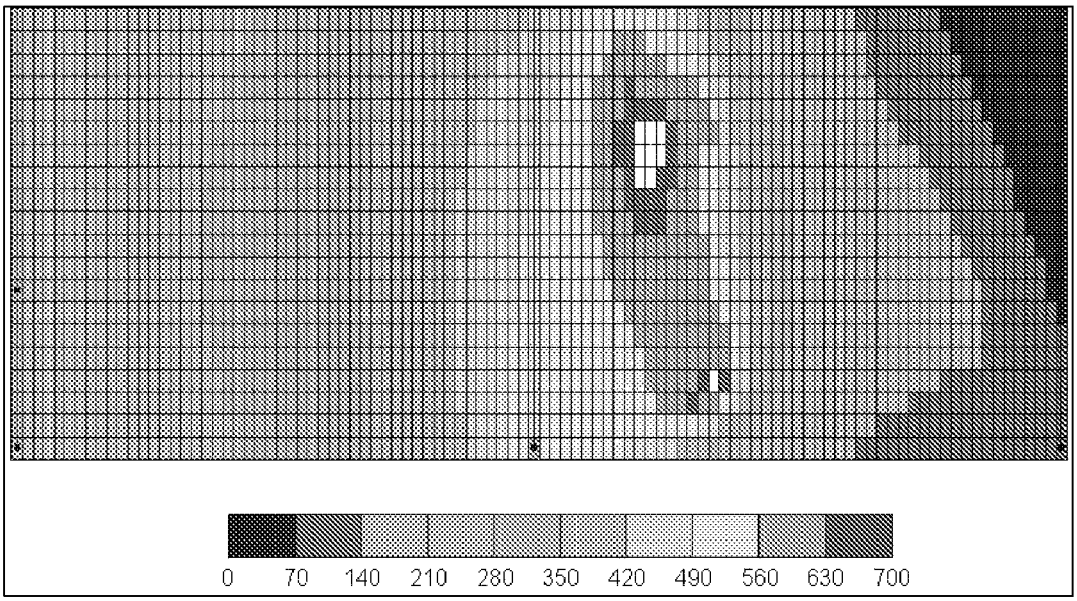
FIG. 12 is a graph depicting temperature distribution throughout the non-symmetrical numerical model of FIG. 2 on day 3519 from a CMG STARS™ simulation of a staged application of the method of the invention.

The progression of the combustion zone (70) during the performance of the method of the invention is shown from the temperature distributions over the reservoir (22) cross section in FIG. 12 on day 3,519 of the simulation. The band of the combustion zone (70) becomes increasingly broader and hotter as it moves away from the injection line (38). The temperature reaches as high as 1,000° C., and the combustion zone (70) extends nearly 50 meters across certain layers as the combustion zone (70) approaches the first set of offset liquid production wellbores (42) on day 2,137 of the simulation. Oxygen consumption increases dramatically at these times as seen in the cumulative OOR curve in FIG. 11. The increase in the oxygen uptake is due to the occurrence of a high temperature oxidation reaction over a large spreading hot zone. Associated with the high oxygen uptake is the high gas velocity toward the first set of offset liquid production wellbores (42). Water may be co-injected or the air injection pressure and/or rate may be lowered in order to inhibit the expanding of the combustion zone (70). In the subject simulation run, the air injection pressure was kept constant at 5 MPa throughout the simulation, and no attempt was made to optimize the process.

Figure 13:
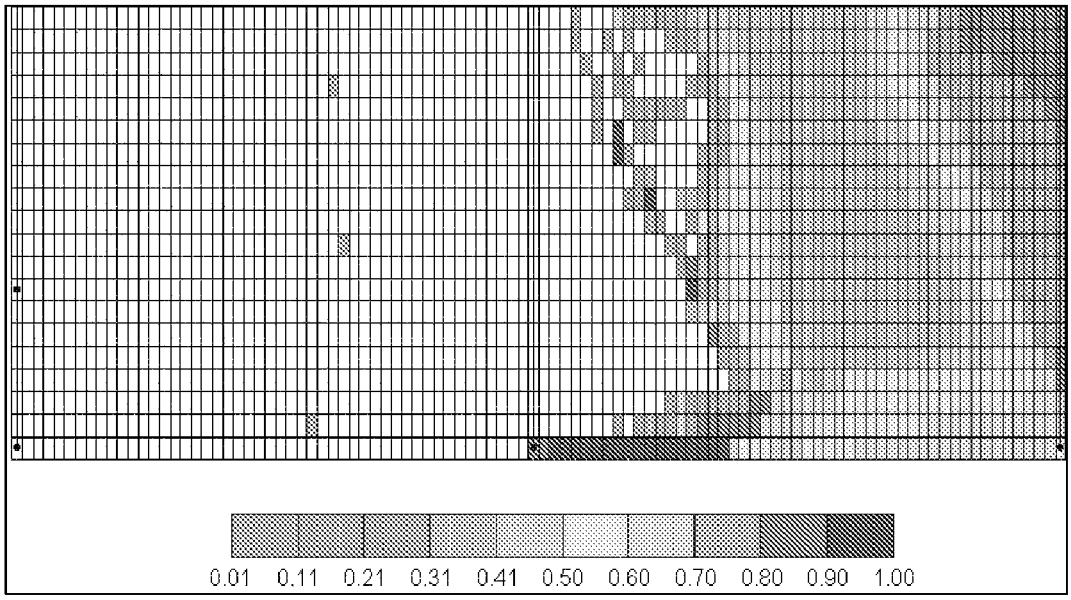
FIG. 13 is a graph depicting hydrocarbon (oil) saturation throughout the non-symmetrical numerical model of FIG. 2 on day 3519 from a CMG STARS™ simulation of a staged application of the method of the invention.

The corresponding distributions of oil saturation of FIG. 13 show that no residual oil is left in the region behind the combustion zone (70) as the oil is completely consumed as fuel by the combustion process. The voidage in the depleted region is occupied by gases. Oxygen concentration in the gas phase is over 20% where the gas saturation approaches 1. Although high oxygen concentration is drawn close to the bottom layer and to the first set of offset liquid production wellbores (42), very little un-reacted oxygen is produced because of the constraints of the "oxygen trap" imposed on all of the production wellbores (26,42,50).

(f) Conclusions from Simulation Study

The simulation results suggest that the method of the invention compares quite favourably with a multi-stage SAGD process with respect to cumulative daily oil production rates, oil recoveries, and energy requirements. Under the modelled reservoir conditions studied, the calendar day oil production rate of the method of the invention over 10 years of operations is 81.4 $m^3$/day per equivalent SAGD well pair, which is 28% higher than that obtained with the multi-stage SAGD process. The energy requirement for the method of the invention is 6.5 GJ/$m^3$ of oil produced, which is 71% less than the energy requirement for the multi-stage SAGD process.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A system for recovering a hydrocarbon liquid from a subterranean reservoir containing hydrocarbons, the system comprising:

(a) a primary liquid production wellbore having a substantially horizontal primary production length which extends through the reservoir, wherein the primary production length is positioned substantially within a vertical primary production plane;

(b) at least one vent well in fluid communication with the reservoir at a venting position in the reservoir which is relatively higher in the reservoir than the primary production length;

(c) an injector apparatus in fluid communication with the reservoir along an injection line in the reservoir which is substantially parallel with the primary production plane, wherein the injection line extends along at least a portion of the primary production length, wherein the injection line is relatively higher in the reservoir than the primary production length, and wherein the injection line is relatively lower in the reservoir than the venting position; and (d) an injection gas source comprising a source of an injection gas containing oxygen connected with the injector apparatus, for supplying the injection gas containing oxygen to the injector apparatus for injecting along the injection line in order to cause combustion of the hydrocarbons contained in the reservoir.

2. The system as claimed in claim 1 wherein the injection line is positioned substantially within the primary production plane.

3. The system as claimed in claim 1 wherein the injector apparatus is comprised of an injection wellbore having a substantially horizontal injection length and wherein the injection line is comprised of the injection length of the injection wellbore.

4. The system as claimed in claim 1 wherein the injector apparatus is comprised of a plurality of injection wellbores and wherein each of the injection wellbores is in fluid communication with the reservoir along the injection line.

5. The system as claimed in claim 4 wherein the injector apparatus is comprised of a row of substantially vertical injection wellbores.

6. The system as claimed in claim 1 wherein the venting position is laterally offset from the primary production plane.

7. The system as claimed in claim 6 wherein the at least one vent well is comprised of a plurality of vent wells, wherein the venting position is comprised of a plurality of venting positions provided by the plurality of vent wells, and wherein each of the venting positions is laterally offset from the primary production plane.

8. The system as claimed in claim 7 wherein at least one of the venting positions is laterally offset from the primary production plane on a first side of the primary production plane and wherein at least one of the venting positions is laterally offset from the primary production plane on a second side of the primary production plane.

9. The system as claimed in claim 7 wherein at least one of the venting positions is laterally offset from the primary production plane by a first venting distance on a first side of the primary production plane, wherein at least one of the venting positions is laterally offset from the primary production plane by a second venting distance on the first side of the primary production plane, and wherein the second venting distance is greater than the first venting distance.

10. The system as claimed in claim 1, further comprising a first offset liquid production wellbore having a substantially horizontal first offset production length which extends through the reservoir, wherein the first offset production length is laterally offset from the primary production plane by a first production distance on a first side of the primary production plane.

11. The system as claimed in claim 10 wherein the injection line is relatively higher in the reservoir than the first offset production length.

12. The system as claimed in claim 10 wherein the first offset production length is substantially parallel with the primary production plane.

13. The system as claimed in claim 10, further comprising a second offset liquid production wellbore having a substantially horizontal second offset production length which extends through the reservoir, wherein the second offset production length is laterally offset from the primary production plane by a second distance on the first side of the primary production plane, and wherein the second production distance is greater than the first production distance.

14. The system as claimed in claim 13 wherein the injection line is relatively higher in the reservoir than the second offset production length.

15. The system as claimed in claim 13 wherein the second offset production length is substantially parallel with the primary production plane.

16. The system as claimed in claim 13, further comprising a third offset liquid production wellbore having a substantially horizontal third offset production length which extends through the reservoir, wherein the third offset production length is laterally offset from the primary production plane by a third production distance on a second side of the primary production plane.

17. The system as claimed in claim 16 wherein the injection line is relatively higher in the reservoir than the third offset production length.

18. The system as claimed in claim 16 wherein the third offset production length is substantially parallel with the primary production plane.

19. The system as claimed in claim 16, further comprising a fourth offset liquid production wellbore having a substantially horizontal fourth offset production length which extends through the reservoir, wherein the fourth offset production length is laterally offset from the primary production plane by a fourth production distance on the second side of the primary production plane, and wherein the fourth production distance is greater than the third production distance.

20. The system as claimed in claim 19 wherein the injection line is relatively higher in the reservoir than the fourth offset production length.

21. The system as claimed in claim 19 wherein the fourth offset production length is substantially parallel with the primary production plane.

22. The system as claimed in claim 19 wherein the third offset liquid production wellbore and the first offset liquid production wellbore comprise a first set of offset liquid production wellbores, wherein the fourth offset liquid production wellbore and the second offset liquid production wellbore comprise a second set of offset liquid production wellbores, wherein the third production distance is substantially equal to the first production distance, and wherein the fourth production distance is substantially equal to the second production distance.

23. The system as claimed in claim 10, further comprising a third offset liquid production wellbore having a substantially horizontal third offset production length which extends through the reservoir, wherein the third offset production length is laterally offset from the primary production plane by a third production distance on a second side of the primary production plane.

24. The system as claimed in claim 23 wherein the injection line is relatively higher in the reservoir than the third offset production length.

25. The system as claimed in claim 23 wherein the third offset production length is substantially parallel with the primary production plane.

26. A method for recovering a hydrocarbon liquid from a subterranean reservoir containing hydrocarbons, the method comprising:

(a) providing a primary liquid production wellbore having a substantially horizontal primary production length which extends through the reservoir, wherein the primary production length is positioned substantially within a vertical primary production plane;

(b) providing at least one vent well in fluid communication with the reservoir at a venting position in the reservoir which is relatively higher in the reservoir than the primary production length;

(c) providing an injector apparatus in fluid communication with the reservoir along an injection line in the reservoir which is substantially parallel with the primary production plane, wherein the injection line extends along at least a portion of the primary production length, wherein the injection line is relatively higher in the reservoir than the primary production length, and wherein the injection line is relatively lower in the reservoir than the venting position;

(d) injecting an injection gas containing oxygen into the reservoir along the injection line in order to cause combustion of the hydrocarbons contained in the reservoir, thereby heating the reservoir so that the hydrocarbon liquid drains toward the primary liquid production wellbore;

(e) producing the hydrocarbon liquid from the primary liquid production wellbore; and (f) venting, from the vent well, gases contained in the reservoir.

27. The method as claimed in claim 26, further comprising injecting steam into the reservoir along the injection line for a steam injection period before injecting the injection gas into the reservoir.

28. The method as claimed in claim 26 wherein the injection line is positioned substantially within the primary production plane.

29. The method as claimed in claim 26 wherein the injector apparatus is comprised of an injection wellbore having a substantially horizontal injection length and wherein the injection line is comprised of the injection length of the injection wellbore.

30. The method as claimed in claim 26 wherein the injector apparatus is comprised of a plurality of injection wellbores and wherein each of the injection wellbores is in fluid communication with the reservoir along the injection line.

31. The method as claimed in claim 30 wherein the injector apparatus is comprised of a row of substantially vertical injection wellbores.

32. The method as claimed in claim 26 wherein the venting position is laterally offset from the primary production plane.

33. The method as claimed in claim 32 wherein the at least one vent well is comprised of a plurality of vent wells, wherein the venting position is comprised of a plurality of venting positions provided by the plurality of vent wells, and wherein each of the venting positions is laterally offset from the primary production plane.

34. The method as claimed in claim 33 wherein at least one of the venting positions is laterally offset from the primary production plane on a first side of the primary production plane and wherein at least one of the venting positions is laterally offset from the primary production plane on a second side of the primary production plane.

35. The method as claimed in claim 33 wherein at least one of the venting positions is laterally offset from the primary production plane by a first venting distance on a first side of the primary production plane, wherein at least one of the venting positions is laterally offset from the primary production plane by a second venting distance on the first side of the primary production plane, and wherein the second venting distance is greater than the first venting distance.

36. The method as claimed in claim 26, further comprising providing a first offset liquid production wellbore having a substantially horizontal first offset production length which extends through the reservoir, wherein the first offset production length is laterally offset from the primary production plane by a first production distance on a first side of the primary production plane, and further comprising producing the hydrocarbon liquid from the first offset liquid production wellbore.

37. The method as claimed in claim 36, further comprising ceasing producing the hydrocarbon liquid from the primary liquid production wellbore upon detection of a threshold amount of a breakthrough gas at the primary liquid production wellbore.

38. The method as claimed in claim 36 wherein the injection line is relatively higher in the reservoir than the first offset production length.

39. The method as claimed in claim 36 wherein the first offset production length is substantially parallel with the primary production plane.

40. The method as claimed in claim 36, further comprising providing a second offset liquid production wellbore having a substantially horizontal second offset production length which extends through the reservoir, wherein the second offset production length is laterally offset from the primary production plane by a second production distance on the first side of the primary production plane, wherein the second production distance is greater than the first production distance, and further comprising producing the hydrocarbon liquid from the second offset liquid production wellbore.

41. The method as claimed in claim 40, further comprising ceasing producing the hydrocarbon liquid from the primary liquid production wellbore upon detection of a threshold amount of a breakthrough gas at the primary liquid production wellbore.

42. The method as claimed in claim 40, further comprising ceasing producing the hydrocarbon liquid from the first offset liquid production wellbore upon detection of a threshold amount of a breakthrough gas at the first offset liquid production wellbore.

43. The method as claimed in claim 42, further comprising injecting the injection gas into the reservoir along the first offset production length after ceasing producing the hydrocarbon liquid from the first offset liquid production wellbore.

44. The method as claimed in claim 43, further comprising injecting into the reservoir along the injection line at least a portion of the gases which are vented from the vent well.

45. The method as claimed in claim 43, further comprising injecting into the reservoir along the primary production length at least a portion of the gases which are vented from the vent well.

46. The method as claimed in claim 40 wherein the injection line is relatively higher in the reservoir than the second offset production length.

47. The method as claimed in claim 40 wherein the second offset production length is substantially parallel with the primary production plane.

* * * * *